US009144122B2

(12) United States Patent
Williams et al.

(10) Patent No.: US 9,144,122 B2
(45) Date of Patent: Sep. 22, 2015

(54) DRIVER FOR ARRAYS OF LIGHTING ELEMENTS

(71) Applicants: Donald V Williams, Woodford (AU); David Dreyfuss, Palo Alto, CA (US)

(72) Inventors: Donald V Williams, Woodford (AU); David Dreyfuss, Palo Alto, CA (US)

(73) Assignee: Intervention Technology PTY, LTD, Richmond, Victoria (AU)

( * ) Notice: Subject to any disclaimer, the term of this patent is extended or adjusted under 35 U.S.C. 154(b) by 0 days.

(21) Appl. No.: 14/369,983

(22) PCT Filed: Dec. 31, 2012

(86) PCT No.: PCT/US2012/072253
§ 371 (c)(1),
(2) Date: Jun. 30, 2014

(87) PCT Pub. No.: WO2013/102183
PCT Pub. Date: Jul. 4, 2013

(65) Prior Publication Data

US 2015/0035449 A1 Feb. 5, 2015

Related U.S. Application Data

(60) Provisional application No. 61/582,351, filed on Dec. 31, 2011.

(51) Int. Cl.
*H05B 37/02* (2006.01)
*H05B 33/08* (2006.01)

(52) U.S. Cl.
CPC ..... *H05B 33/0809* (2013.01); *H05B 33/0815* (2013.01); *H05B 33/0824* (2013.01); *H05B 33/0845* (2013.01)

(58) Field of Classification Search
CPC ..... H05B 33/0809; H05B 33/0845
USPC ..... 315/250, 294, 299
See application file for complete search history.

(56) References Cited

U.S. PATENT DOCUMENTS

2009/0167202 A1* 7/2009 Miskin et al. ..... 315/250
2011/0199007 A1 8/2011 Yang
2011/0285301 A1 11/2011 Kuang et al.

OTHER PUBLICATIONS

International Search Report May 9, 2013.

* cited by examiner

*Primary Examiner* — Daniel D Chang
(74) *Attorney, Agent, or Firm* — Moore Patents; David Dreyfuss; Cynthia R. Moore

(57) ABSTRACT

A lighting system is disclosed comprising an excitor which drives at least one reactor. The excitor is an electrical waveform generator that creates an AC waveform at a frequency between about 50 kHz and about 100 MHz. The reactor is an under-damped resonant circuit that includes a network of lighting elements. Reactive components are distributed among the lighting elements. These reactive components can regulate the current and voltage to individual lighting elements. The drive system is particularly useful for arrays of low-voltage lighting elements such as LEDs. It is fault tolerant in that the failure of individual elements need not affect the operation of remaining elements, and elements can be added and removed without affecting the serviceability of other elements.

22 Claims, 17 Drawing Sheets

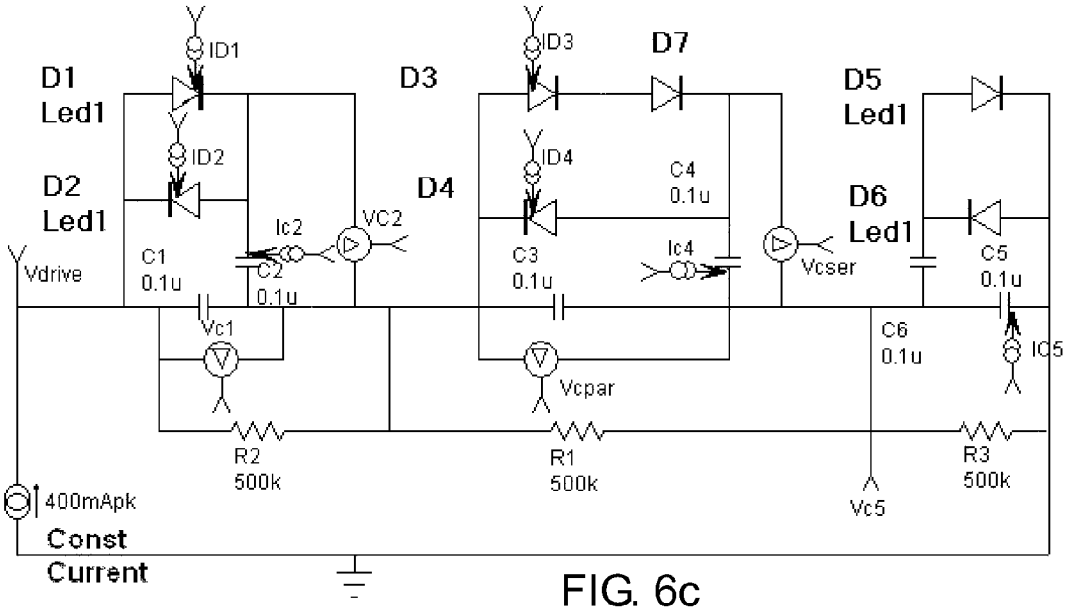
FIG. 6c
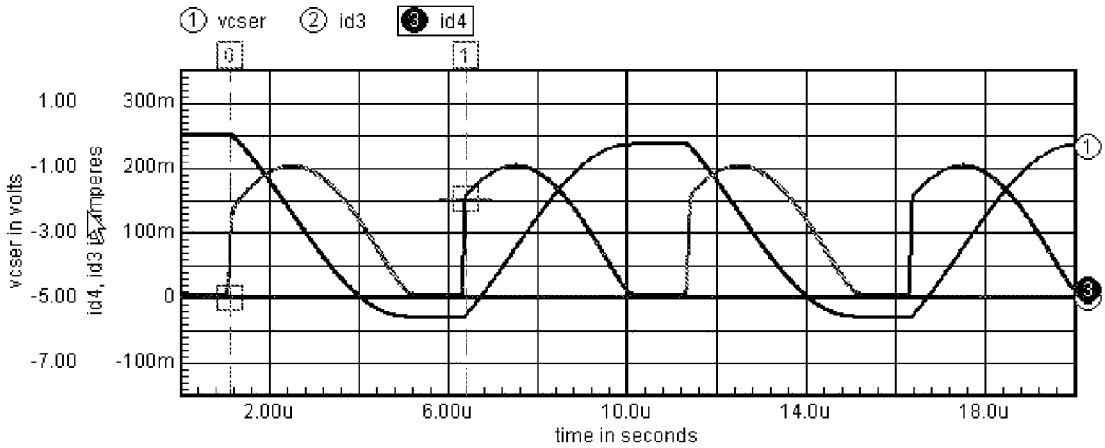
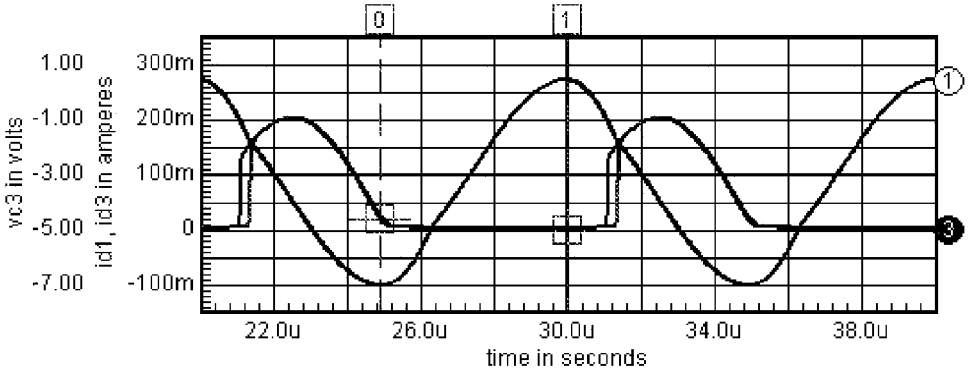
FIG. 6d
FIG. 6e

DRIVER FOR ARRAYS OF LIGHTING ELEMENTS

RELATED APPLICATIONS

This application claims priority to U.S. Provisional Application No. 61/582,351, filed 31 Dec. 2011, which is herein incorporated by reference.

FIELD OF THE INVENTION

One or more embodiments of the present invention relates to systems and methods for driving a plurality of lighting elements.

BACKGROUND

Light emitting diodes (LEDs) are often arranged in series and/or parallel combinations as lines/strings or arrays for particular lighting applications. An LED is electrically a diode which conducts in one direction only, just like diodes used for non-optical applications. LEDs are inherently low-voltage devices with a luminous output proportional to a forward drive current. Conventional LED lighting systems therefore include some sort of current driver, designed to convert available power such as AC power from the mains to a DC current suitable to drive LEDs. Drivers can be designed to drive single LEDs or to drive systems comprising a multiplicity of LEDs arranged in series and/or parallel. When driving a multiplicity of LEDs, a failure such as a short circuit or open circuit means any single LED can cause complete failure of the system by either failing to drive or damaging remaining LEDs.

There are also LED drivers that use AC current. U.S. Pat. No. 7,573,729 B2 to Elferich and Lurkens discloses a resonant circuit located on the primary side of an output transformer; the secondary side drives LEDs, paired with reversed polarities so that one LED of each pair conducts during each half cycle of the AC current. Multiple pairs can be connected in series. However, this design is also sensitive to failure of individual LEDs. A string of many pairs looks like a single element to the drive circuit, and a failure of any component within the string can cause the entire string to be disabled. Further the required resonance can be destroyed.

U.S. Pat. No. 8,145,905 B2 to Miskin et al. discloses another driver using AC current and "anti-parallel" LEDs. Miskin discloses a "fixed high frequency inverter" having a fixed frequency and voltage AC output. The inverter drives various possible networks of LED couplets (the anti-parallel LEDs). Current can be adjusted to individual couplets or series strings of couplets using a capacitor or resistor. No series or parallel inductor is used in the LED circuit and no bypass capacitors are used. The output circuit is driven at a specific frequency and specific voltage and does not take advantage of any inherent resonance. The resulting system is sensitive to failure of single LEDs. The current waveforms in the LEDs are likely to exhibit significant harmonic distortion and are therefore likely to emit significant radio frequency interference. Overall energy efficiency is not as high as in a resonant system.

U.S. Pat. No. 6,826,059 B2 to Böckle and Hein discloses an LED driver based on ballasts for fluorescent lighting. The output is a resonant circuit. The LEDs are configured in strings or arrays, with either one array or two arrays arranged in opposite polarity. Each array consists entirely of LEDs with no reactive components. A single inductor and two capacitors outside of the arrays complete the resonant circuit; there are no reactive components distributed through the LED arrays.

What is needed is a drive circuit that can self-adjust to provide controlled power to individual elements in an LED array that is additionally insensitive to the failure of individual LEDs (short circuit or open circuit) and does not require additional active semiconductor components.

SUMMARY OF THE INVENTION

A lighting system is disclosed comprising an excitor which drives at least one reactor. The excitor is an electrical waveform generator that creates an AC waveform at a frequency between about 50 kHz and about 100 MHz. The reactor is an under-damped resonant circuit that includes a network of lighting elements. Reactive components are distributed among the lighting elements. These reactive components can regulate the current and voltage to individual lighting elements. The drive system is particularly useful for arrays of low-voltage lighting elements such as LEDs. It is fault tolerant in that the failure of individual elements need not affect the operation of remaining elements, and elements can be added and removed without affecting the serviceability of other elements.

The reactor contains no semiconductor elements other than the lighting elements for its essential function. LEDs are connected in couplet pairs for most reactive string topologies (anode of one to cathode of the other). The lighting system can be dimmed by lowering the Q of the resonance of the resonant circuit by increasing the excitor drive frequency or by lowering the resonant frequency of the reactor resonant circuit.

The reactor can also be configured with a plurality of distinct reactors each with independent resonant circuits. These can be dimmed individually.

Additional lighting elements can be added to a network of lighting elements, and the resonant circuit continues to oscillate and drive both the additional lighting elements and the lighting elements already part of the network of lighting elements. The lighting elements in one distinct reactor can be different in type and number from those in others. Individual lighting elements and/or individual reactors can be added or removed from the system without affecting the operation of remaining elements or reactors.

Exemplary lighting systems can be used for area illumination, photo-therapy, sterilisation, stimulating a photochemical reaction, stimulating photo-luminescence or for the elements of a luminous display device.

The reactor can be remote from the excitor using a two-wire connection.

BRIEF DESCRIPTION OF THE DRAWINGS

FIG. 6*c* shows a model array of lighting cells, similar to that of FIG. 5*a* but with unequal values of $V_{fwrd}$.

FIGS. 6*d* and 6*e* shows selected current and voltage waveforms for the model array of lighting cells shown in FIG. 6*c*.

DETAILED DESCRIPTION

Figure 1:
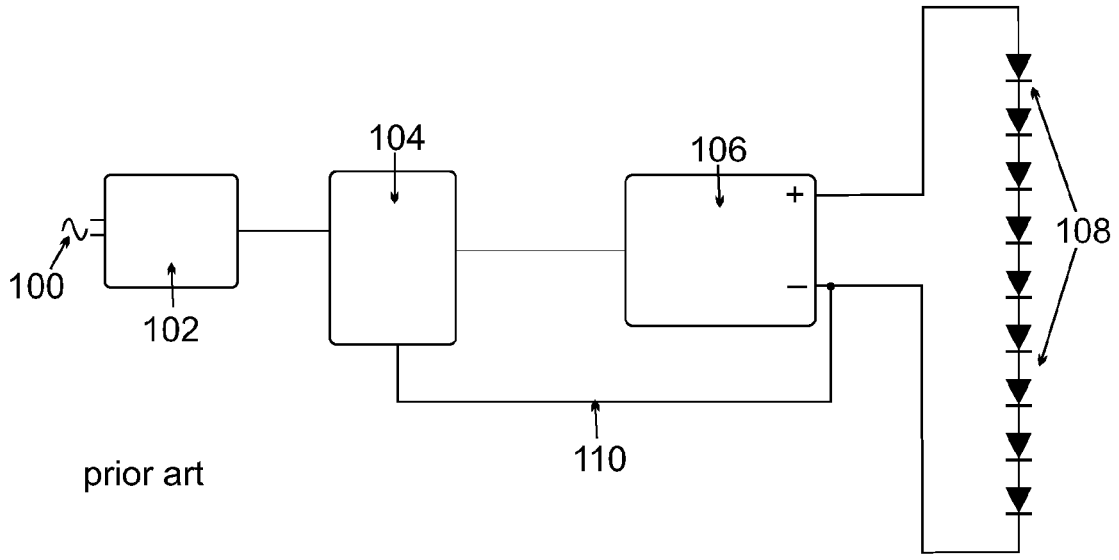
FIG. 1 shows a prior art system for DC driving a series-connected chain of LEDs.

Before the present invention is described in detail, it is to be understood that unless otherwise indicated this invention is not limited to specific circuits, lighting elements, or types of lighting elements. Any lighting system comprising a plurality of lighting elements can be beneficially driven using the circuitry described herein. It is also to be understood that the terminology used herein is for the purpose of describing particular embodiments only and is not intended to limit the scope of the present invention. Typical examples are described using LEDs as exemplary embodiments, but other lighting elements can also be used. Similarly, exemplary embodiments are described for use in area lighting, but other embodiments can be used for image displays, photo-therapy, photo-luminescence, sterilisation, biochemistry and photochemistry among other applications.

It must be noted that as used herein and in the claims, the singular forms "a," "and" and "the" include plural referents unless the context clearly dictates otherwise. Thus, for example, reference to "an LED" includes two or more LEDs, and so forth.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention. The term "about" generally refers to ±10% of a stated value. The term "substantially all" generally refers to an amount greater than 95% of the total possible amount.

DEFINITIONS

As used herein, the term "light emitting diode" or "LED" refers to a semiconductor diode which emits light when electrical current is passed through the diode. Any type of LED can be used including devices emitting light at any available wavelength, luminosity, or input power. Any available semiconductor materials can be used, and any available package design can be used provided that appropriate electrical connections to the "excitor" can be made, and an appropriate "reactor" can be configured.

As used herein, the term "steering diode" refers to a diode not used to emit light but only to direct current flow in specific pathways.

As used herein, the term "excitor" refers to a circuit which converts a source of electrical energy to an AC voltage source with a voltage and frequency suitable to drive a "reactor."

As used herein, the term "reactor" refers to a network or array of lighting elements and reactive devices which comprises a resonant circuit.

As used herein, the term "lighting element" refers to any component that emits visible light, either directly (e.g., incandescent bulbs, arc lamps, visible-light LEDs) or indirectly (e.g., fluorescent lamps, LEDs with phosphors). Lighting elements also include organic LEDs (OLEDs), quantum dots, microcavity plasma lamps, electroluminescent devices, and any element that can convert electrical current to visible light.

As used herein, the term "reactive component" refers to an electronic component which has little or no real impedance (i.e., resistance) but has significant imaginary impedance (i.e., reactance in the form of inductance and or capacitance). Reactive components are generally devices sold as capacitors, inductors, transformers, and the like intended to add capacitance and/or inductance to a circuit, but not significant resistance.

As used herein, the term "reactive string" refers to a reactor comprising a plurality of cells each comprising lighting elements and reactive components. A reactive string may optionally include current-steering diodes, but it contains no other semiconductor devices and no power dissipating devices other than the lighting elements themselves.

As used herein, the term "resonant circuit" refers to a circuit which has a natural oscillating frequency and is intended to be driven close to resonance or is used "underdamped," whereby any energy absorption by such as LED resistance in the circuit is insufficient to suppress oscillation; i.e., the circuit will continue to "ring" or oscillate for at least one cycle when no longer driven.

As used herein, the term "quality factor" or "Q" is used to characterise the damping of a resonant system. Q also describes the sharpness of the resonance. It is defined by Q=2π (energy stored)/(energy dissipated per cycle). It can also be calculated as $Q=\omega_0/\Delta\omega$, where $\omega_0$ is the resonant frequency and $\Delta\omega$ is the half width of the power spectrum, also called the "bandwidth" of the resonance. An under-damped resonant circuit exhibiting voltage or current magnification has Q>1.

As used herein, the term "current utility ratio" (CUR) refers to the ratio of rms current passing through the lighting elements in a reactor to the total rms current supplied to the reactor. The CUR is less than one when bypass elements such as capacitors are placed parallel to lighting elements.

As used herein, the terms "strike voltage" and "breakover voltage" ($V_b$) are interchangeable and refer to the voltage above which a particular network of devices starts to conduct and draw non-negligible current. If the network of devices consists of a single LED, the term "forward voltage" ($V_{frwd}$) is used instead.

As used herein, the term "array" refers to arrangements of pluralities of connected elements having any dimension, for example, two-dimensional arrays, one-dimensional (linear) configurations, as well as configurations that can be construed as having three or more dimensions.

As used herein the term "regulated" refers to control of a particular electrical parameter (such as voltage, current, or power) in the presence of a changing environment. It does not mean there is no change in the value of the parameter, but rather that any change is functionally insignificant in the local context.

Overview:

Embodiments of the present invention provide regulated power to individual lighting elements arranged in array configurations interspersed with reactive components. These arrays are referred to as reactive strings. Among the topologies of reactive strings there are embodiments which provide three advantageous properties: (1) the current/voltage regulation is sufficiently robust that some level of element failure can be tolerated without significant effect on the light output of remaining functional elements (2) the array itself is an essential component of the power transforming process (e.g., AC to DC), and (3) currents and voltages to individual elements in the array are regulated in a way that is tolerant of device variability and manufacturing tolerances.

Reactive strings can have a variety of attributes. In some embodiments, the reactive strings have constant luminance, whereby when some elements fail, the balance of the elements increase their current to provide constant luminance. The current changes only minimally in the balance of the elements. This behaviour is a consequence of appropriate selection of the interspersed reactive components. If the topology is initially configured for maximum luminosity, then the remaining elements continue to operate at the same current for maximum residual luminosity. Still another is to provide an increased crest factor with a lower duty cycle for either photo-luminescence or chemical/phototherapy. Light output can be maximised and heat dissipation can be minimised.

A "reactor" comprises the reactive strings and also at least one inductor and one capacitor to form a resonating circuit in which substantially all power dissipation occurs in the lighting elements. The additional control elements can be passive reactive components having minimal loss. No dissipative elements such as resistors are required to adjust individual lighting element currents. Further, the resonant behaviour provides pseudo-regulation of the current to regulate light output.

The LED excitation uses AC currents, and the distribution of power among the LED population uses reactive components. Overall reliability is improved, component count is minimised, and the overall system cost can be low. The autonomous or self regulation of the power distribution results in a system which is less complex and safer for use in human living spaces, because the high operating frequencies are neurologically benign, and the passive reactor components replace the proliferation of active power supplies in typical installations. In some embodiments, a single excitor can be used to drive multiple reactors. For example, a single excitor in a distribution panel could drive all the reactors required to illuminate a typical home.

Large displays comprising arrays of LEDs as pixels, general area illumination, LED arrays for phototherapy, photo-luminescence or chemical processing all present unique challenges for power regulation and distribution. Considering the power consumption, the voltage required to drive each LED element is very low, typically 1-3.5 V, but the current required is quite large, typically 20-350 mA or even more. It can be advantageous to connect individual LEDs in series to form strings that require higher total drive voltages and to connect strings in parallel so as to adjust net array voltage and current needs to values that are convenient to generate and distribute.

LED drivers often use current limiting resistors in series with each LED to allow the use of larger voltages at the required current. Such current-limiting resistors are not required in embodiments of the present invention and are considered undesirable, because they waste power in the form of heat.

If N LEDs are connected in parallel and driven, for example, at 3.2 V, the current is N times the requirement for a single LED. For example, if 100 LEDs each requiring 350 mA were connected in parallel then the current required would be 35 A, and the power consumed would be 3.2 V×35 A=112 W. It is difficult to regulate such a high current at low voltage, and significant output filtering would be needed. The voltage reduction (e.g., using a switch-mode power supply) from a mains AC voltage of 240 $V_{rms}$, for example, tends to be inefficient. Further, the light output of the LED itself would vary, because it is very sensitive to the applied voltage. A variation from 2.9 to 3.2 V across the entire parallel loading of LEDs would result in a large variation in light output, and there would be no accommodation for the voltage and current requirements of individual LEDs. This forced commonality of voltage operation in a parallel connection means that marginal devices with a lower forward voltage junction will consume non-linearly increased current. This can result in failure of the LED and reduced service life. Operating at less than full power (e.g., for dimming or image formation) can be even more inefficient, because large currents must be switched or regulated. The problems of regulation efficiency become even more apparent when one notes that failures of any LED can be either "short circuit" where the LED becomes a zero resistance connection between the high current rails, or open circuit where there is no effect except the overall reduction of one LED current. A short circuit for one LED in the parallel connection may cause over-current shut-down of the entire array.

If LEDs are connected in series, then the voltage needed for the same 100 LEDs will be say, 100×3.2 V=320 V and the current will be 350 mA. The total power consumption is again 112 W. The regulation is easier and efficiency can be higher. However, the impedance of individual LEDs can vary and the voltage drop across each can vary accordingly with unequal power consumption. Further, the most common failure is an open-circuit of one LED, and such a failure interrupts power to the entire string which then becomes inoperative. Notwithstanding this reliability limitation, the series connection with current controlled DC drive is the most common approach, because it is cheaper and allows smaller and lower cost power supply devices to be used.

With regard to reliability, it is noted that if, for example, an individual LED is specified by a manufacturer to have a "mean time to failure" (MTBF) of 100,000 hr, then the MTBF of a string of 100 LEDs would be 100,000/100=1000 hr or only about 42 days of continuous operation.

Figure 3:
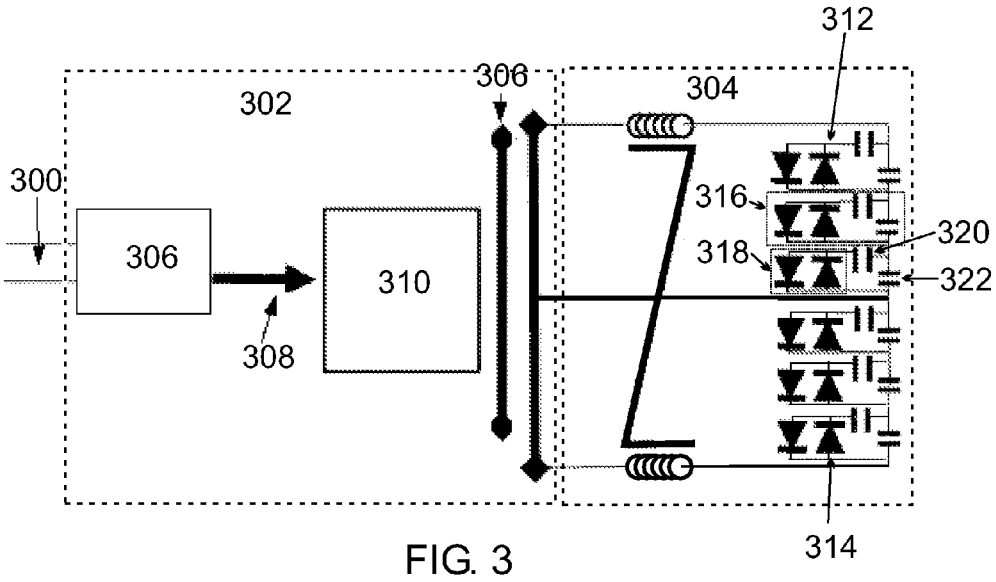
FIG. 3 shows an embodiment of AC-driving using an excitor-reactor arrangement according to the present invention.

Embodiments of the present invention provide a new method of driving an array of LEDs which integrates an "excitor" with a resonant "reactor" as shown in FIG. 3. The excitor is not resonating itself but supplies low voltage AC excitor power to the reactor. A conventional power factor correction (PFC) output stage for driving LEDs provides constant (DC) voltage. Embodiments of the present invention do not need to fully rectify the voltage.

The excitor power input can simply be a haversine in voltage and current provided by the rectified mains. The real impedance of the resonant load presents a resistive impedance phase angle only, so that a simple chopped haversine of voltage and current created by the excitor retains current substantially in phase with the voltage. The resulting power factor exceeds 0.90 and the LEDs themselves perform the low voltage high current rectification providing a significant efficiency advantage. The resonance is effected in either a single reactor or a plurality of reactors driven by the same excitor but in each case the resonance provides maximal power transfer where the output impedance of the excitor is equal to the input impedance of the reactor. The reactor(s) provide a minimal and effective network of pseudo intra-string regulated reactive arrays of LEDs. Reactive components such as capacitors are added among the LEDs of a reactive string to distribute the current. The excitor provides an AC current (the chopped haversine) capable of driving a variable number of LEDs in arrays via a simple two wire connection. The current and voltage are self-regulating as long as the available resonance energy is not exceeded. The failure of one or multiple elements will not render other LED elements unserviceable. This self-regulation by resonance allows an extensible arrangement of reactor arrays wherein the LED power dissipation can be considered analogous to the damping loss of a resonant circuit.

The LED array forms part of a resonant circuit or "reactor". The "excitor" modifies the incoming supply voltage (for example, mains at 110 V, 60 Hz or 240 V, 50 Hz, or a vehicle battery at 12 VDC) to produce, for example, a resonant circuit at about 50 kHz-100 MHz where the resonant circuit includes the LEDs of the array. The choice of resonant frequency is not critical but must be consistent across each two wire network in order that the reactors will resonate and provide illumination. Higher frequencies generally allow the use of smaller lower-cost capacitors for current limiting and bypass functions (see below), but require additional components and shielding structures to limit radio frequency interference. Exemplary embodiments are described and illustrated herein using 100 kHz. Example circuits have been built using 50 kHz-3 MHz which allows the use of convenient conventional ceramic capacitors and simple inductors.

The resonance can be characterised by the "quality factor" Q, expressed in terms of energy dissipated per cycle. The circuit will remain in resonance under continuous excitation provided Q=2π (max stored energy)/(max dissipated energy) >1, and further provided that the "strike" voltage, or "breakover" voltage of the array is exceeded so as to allow accumulation of energy in the inductance part to commence resonance.

Preferably, the reactor has a resonant frequency within about 5% of the excitor frequency, and has slightly lagging phase to allow minimal but sufficient energy accumulation in the inductance elements such that the excitor drive transistors (e.g., MOSFETs) are operating in zero-voltage switching in, for example, a half bridge excitor topology.

LEDs approximate "constant voltage load"; only differences in current alter the energy dissipated in an LED or an LED array to a first approximation. In some embodiments, the LEDs are assembled as pairs with each pair arranged with opposite polarity (i.e., cathode to anode) in a connectivity referred to as a couplet. The breakover voltage of an array is given by $V_b=V_d\,(N/2)\,V_{frwd}$, where N is the number of LEDs in the array of N/2 pairs connected in series, $V_d$ is a constant between 0.75 and 1.5.

The resonant array is further assisted to begin to conduct in one direction by the stochastic distribution of the values of $V_{frwd}$. As voltage rises from zero, one LED breaks over at a lowest forward voltage and begins to conduct, then the effect cascades as the balance of array elements are incipient to conduction and communal commutation of the array occurs at a rate far faster than the slew of the exciting current phase could be responsible for, until all LEDs in the array are conducting and photo radiant. Consequently, the reactive strings have a significant predisposition for resonance.

Further, it will be shown that the current distributed to individual LED elements is limited in various ways unique to a type of "reactive string". The voltage applied to the LED can be automatically regulated to accommodate varying LED characteristics such as variable $V_{frwd}$ due to manufacturing tolerances. Referring to the example shown in FIG. 5*a*, parallel capacitors (bypass elements C1,3,5,7) can be placed in parallel with each LED pair. These capacitors act to provide voltage regulation as an obvious voltage division of the drive voltage. The regulation of current is provided by the series capacitors which accommodate the various values of $V_{frwd}$. Series capacitors C2,4,6,8 are biased at the average $V_{frwd}$ so equalling the current fed to each LED at phase reversal where they have maximum discharge rate at maximum slew rate of the bypass elements C1,3,5,7. The LEDs thus have peak luminance at maximum current charge or discharge of the resonant inductor. The system is effectively self-biasing.

Figure 5A:
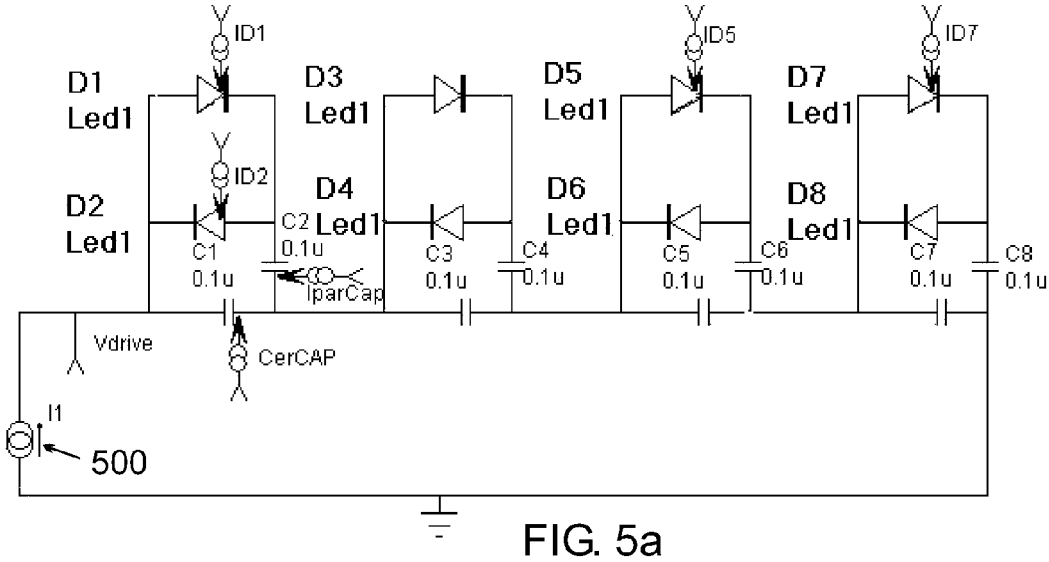
FIG. 5*a* shows a model array of lighting cells, each having a couplet of LEDs with current limiting and bypass capacitors.

With the bypass elements in the array as shown in FIG. 5*a*, for example, a number of typical luminaire manufacturing binning or selection steps are not needed. Chromaticity control is not critical. Nor is forward voltage ($V_{frwd}$), luminous intensity, or colour temperature parameter equivalence as important as for other drive strategies given every cycle the current transits all values providing an averaging effect. Another advantage to embodiments of the present invention is the insensitivity to short circuit or open circuit failure, even of a significant percentage of the individual LEDs in the array. The power supply can also be simpler, particularly if the PFC function is dispensed with. The stored energy in the capacitors can serve to provide all of the required current and voltage regulation directly in the resonant reactor circuit.

Figure 17:
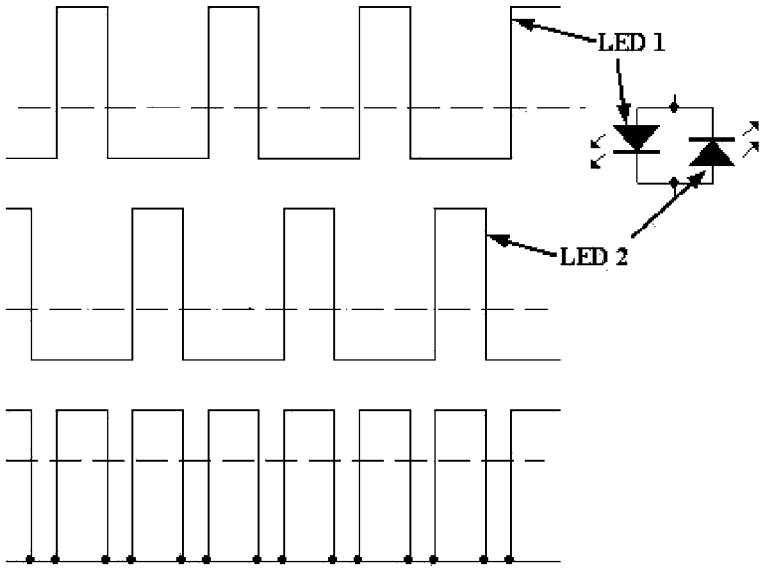
FIG. 17 shows the effect of combining the output of two LEDs driven by an AC excitor.

FIG. 17 shows the typical effect of combining the luminous flux from the two LEDs in a couplet. For simplicity, the flux is shown as rectangular waveforms; in general the waveforms are sinusoids or part sinusoids facilitating EMC regulatory requirements. The flux for LED 1 and LED 2 are shown in the top two traces. Each has an on time of about one third of the period, but the outputs are 180° out of phase. The bottom trace shows the combined flux. Averages are also shown as dashed lines.

While examples described herein generally use capacitors as reactive components to distribute energy among the light elements, a number of other reactive components can be used either singly or in combination. For example, a single primary winding with multiple ferrite core secondary segments about which are wound secondary windings to each LED pair and series capacitor as shown FIG. 18 also allows voltage and current regulation to each LED pair and will operate in resonance with a clamping effect allowing the necessary contra-phase energy transfer between the resonant inductor and resonant capacitor in the resonant circuit.

By contrast, the use of the prior art DC methods for driving LEDs mentioned above has the following difficulties: First, for series-connected LED chains, the chain has a large numbers of interconnected light emitting elements needing significant amounts of current. A DC power supply providing constant current regulation can drive large numbers of LEDs in series. However, a series chain is vulnerable to the failure of just one LED in the chain. Parallel pass elements can be used to ensure that the series chain current is maintained but in general are as expensive as the LEDs themselves and equally prone to failure. For DC operation, two series diodes or other SCR elements can be used, but the circuit complexity and cost is increased and reliability is decreased by the addition of these additional semiconductor parts. Further, there is still a need for overtly designed current regulation. Similarly, the use of either a DC regulated voltage for parallel connected LEDs or a DC regulated current for series connected LEDs requires significant complexity in components used for regulation with consequent adverse effect on reliability. Both series connection and parallel connection arrays with DC power require external circuitry to provide current or voltage limits. For example, for series connection, the drive voltage must be externally limited. Otherwise, when current is unable to be driven through the series chain, the voltage can be excessive. For parallel connection, a current limit must be provided to protect against short circuit of an element.

Embodiments of the present invention use a resonant circuit in each reactor which has a simple design utilising only passive components for its function. The number of reactive components is related to the number of LED elements in the reactor array, and therefore related to the total current or voltage supply needs of the entire LED reactor circuitry. The use of self-regulation by resonance avoids reliance on front-end power supply current regulation, minimising the use of active components and enhancing reliability. The output circuit can be isolated or not and can safely be touched by humans when active during installation. The output circuit is insensitive to component failure.

The currents are inherently limited to safe levels, and the operating frequencies are well above those at which human tissue is neurologically responsive. A light tingle is all that would be felt. There is no possibility of cardiac fibrillation or electrocution. An area lighting system based on the present invention can be much safer than any form of fluorescent or incandescent lighting driven at 50-60 Hz mains voltage in addition to having increased efficiency.

The exemplary reactor circuit embodiment shown in FIG. 3 and FIG. 5*a* shows an equivalent circuit that can be implemented in a variety of specific hardware. Variations to those described here would be known in the art and are also encompassed within the scope of the present invention. Discrete capacitive elements can be used as illustrated by assembly on printed circuit boards (PCBs) or flexible printed circuit boards (FPCBs). The capacitances do not have to be lumped and can be physical attributes of wires and/or conductive films included in the power distribution network. The capacitances can also be integrated into the LED device packages. For example, a suitable modular device can include two anode-to-cathode-connected LEDs and two capacitors each representing a reactor element in the chain shown in FIG. 3 and FIG. 5*a*.

In some embodiments, the excitor can supply power to a number of reactor arrays over considerable distance, for example, 1000 m or more, limited only by the current-carrying capacity of the cable and the total load. This low voltage means of supplying power to a resonating circuit which converts the energy supplied to higher voltage and lower current has numerous commercial and safety advantages. For example, the "excitor" can be located remotely in a fuse box or circuit breaker box or other convenient location. All luminaires can be passive reactors, whether they are incandescent bulb replacements, fluorescent tubes replacements, or LED arrays. Such a system can replace the multitude of power supplies currently used for individual luminaires where each has a limited life and all add to radio frequency interference (RFI) in the local environment.

An advantage of the present invention is that it inherently minimises damage from an electromagnetic pulse or other electromagnetic noise sources. The series inductance naturally limits fast current spikes to the LED array. In topologies that include cell types 1, 2, or 3 (FIG. 11*a*), each cell has a parallel capacitance which limits voltage spikes across a pair of LEDs. Each LED also has a reverse-connected diode which limits the reverse bias that can occur to the $V_{frwd}$ of the reverse-connected diode.

It is also noted that, in these reactive string topologies, the distributed power is effected by sinusoidal voltage and current waveforms. The commutation of the LEDs provides the only non-linear switch events in the entire network given that the main high voltage switching (if needed) occurs at zero voltage. It is further observed that the addition of reactor parts or luminaires increases the energy retained by the lagging phase and improves the sinusoidal voltage waveform of the distributed two wire, polarity indeterminate power distribution which assists in minimising RFI.

Figure 3A:
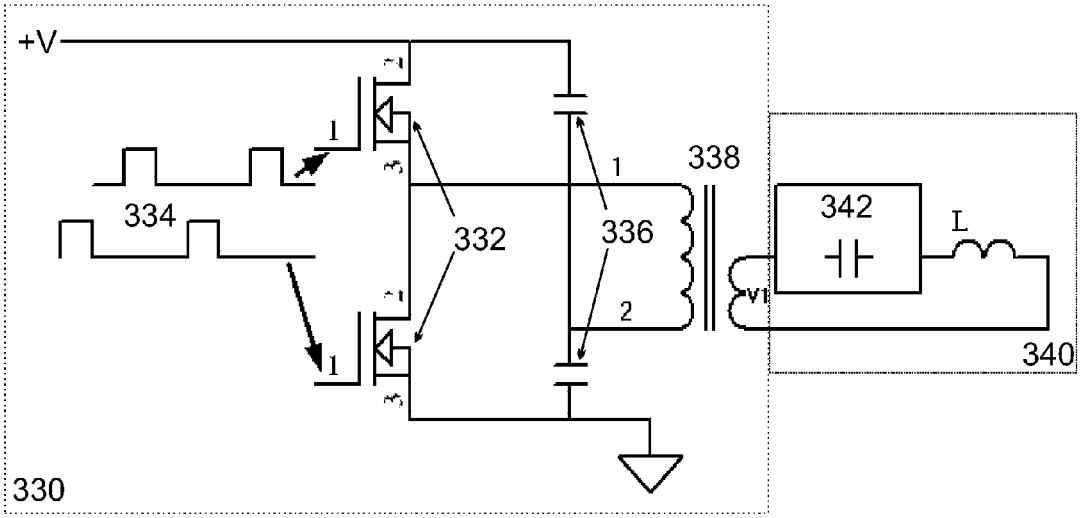
FIG. 3*a* shows an exemplary circuit for an excitor driving a single reactor.

Circuit Details:

An exemplary embodiment of the excitor and reactor of the present invention is shown in FIGS. 3*a, b*, and *c*. The light emitting elements form an inherent part of the resonant power output circuit. Generally, for the "excitor" part to work, there must be at least one "reactor" such that the reactor resonant circuit is slightly lagging phase relative to the excitor circuit drive waveform. This ensures that the excitor output switches (typically comprising MOSFETS or other transistors) operate in zero-voltage switching mode, which minimises radio frequency emissions and minimises heat dissipation. Further, the light output can be "dimmed" by driving the reactor arrays at slightly higher frequency such that Q is reduced, and voltage and current amplification is reduced, thereby dimming the light output.

There are a large number of configurations of LEDs interconnected by reactive passive components (capacitors) that can be driven using a resonant reactor driven by an excitor according to embodiments of the present invention. Each configuration provides different advantages in duty cycle, failure insensitivity, wave-shape or crest factor. The choice of a specific configuration can be made based on such factors as the use of overt power factor correction in the excitor, the quantity and cost of LEDs needed to achieve a desired luminosity, and whether remote phosphors are used.

By designing the secondary side of the transformer to be in resonance with the load, optimal power transfer is ensured, because an AC port is matched to its load precisely when the source and load are in resonance. The use of a transformer is only required when the source energy is supplied from a high voltage source such as the AC mains. The principle of using a resonant power supply to drive arrays of LEDs (or other elements) can also be applied when using low-voltage power sources such as from photovoltaic power sources or batteries where voltage step-down may not be needed. Power conversion efficiency is further optimised for LED usage, because LEDs in reactive arrays can perform the rectification normally performed in the secondary side of a conventional switchmode power supply, thereby saving a source of energy dissipation normally present in the power supply. The semiconductors in LEDs (such as GaAs) do not accumulate "storage charge" and are therefore highly efficient switching materials. This arrangement provides an efficient AC supply to the LEDs of the reactive array which then are operating at a maximum duty cycle of 50%. (The maximum duty cycle can be advantageously reduced in certain applications by using alternate reactive array topologies to allow for greater failure insensitivity by increasing recirculating current in the arrays as described hereunder.)

A low duty cycle LED drive is not necessarily a problem. Typically, the LED can still be driven at the same average power, because the power is typically only limited by average heat dissipation and not peak current. At the typical resonant frequencies used, visible flicker cannot be seen and no filtering of the drive current is required. (No additional capacitance or other storage component is needed.) In some embodiments, additional optical "filtering" may also be present through the use of phosphors with decay times longer than the period of the resonant drive. When using LEDs to pump phosphors, as is often done to produce "white" light from a single-colour LED photo-excitor radiating a shorter and higher energy wavelength, the phosphors effectively average out the fluctuating power of the LED both temporally and spatially to produce a near-DC light source with larger emitting area.

The values of the resonant circuit inductance Lr and capacitance Cr can be chosen to overcome other incidental reactance due to LED construction and lead dressing, as well as connections and wiring between the excitor and the reactor. Separations of 1 Km or more between excitor and reactor can be accommodated. The same design flexibility that allows a system to accommodate a reactor deployed over a wide area can also be applied to high density small-element lighting arrays where the individual elements are, for example, quantum dots or micro-cavity plasma devices.

Figure 12:
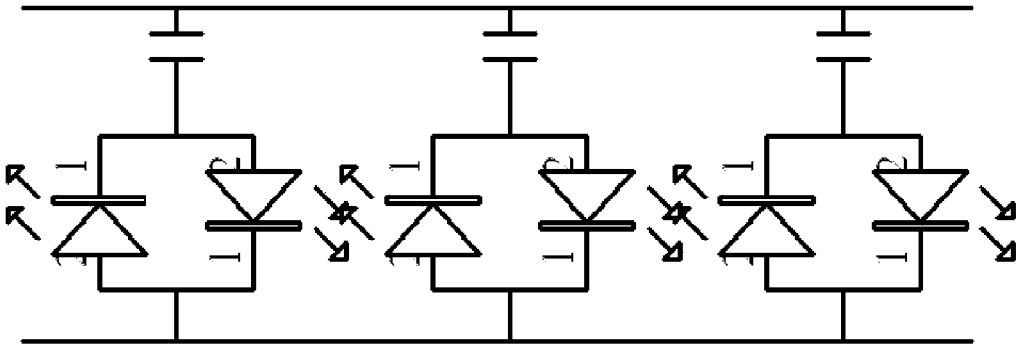
FIG. 12 shows an arrangement of three parallel cells.
Figure 13:
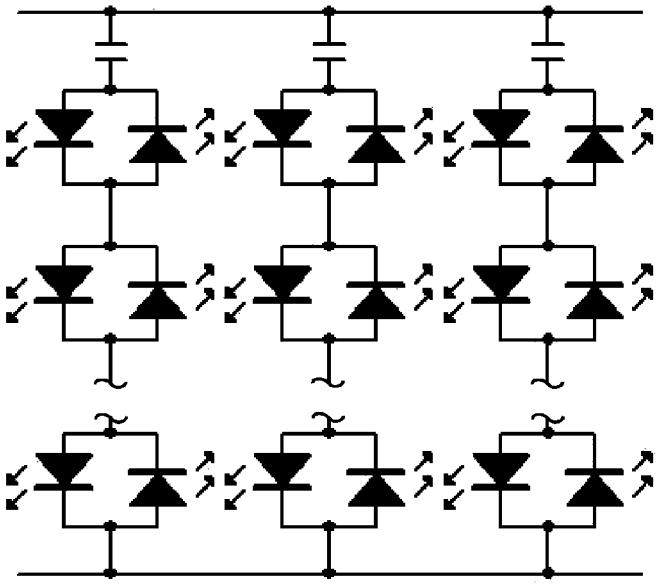
FIG. 13 shows an arrangement of cells using both series and parallel connections.
Figure 14:
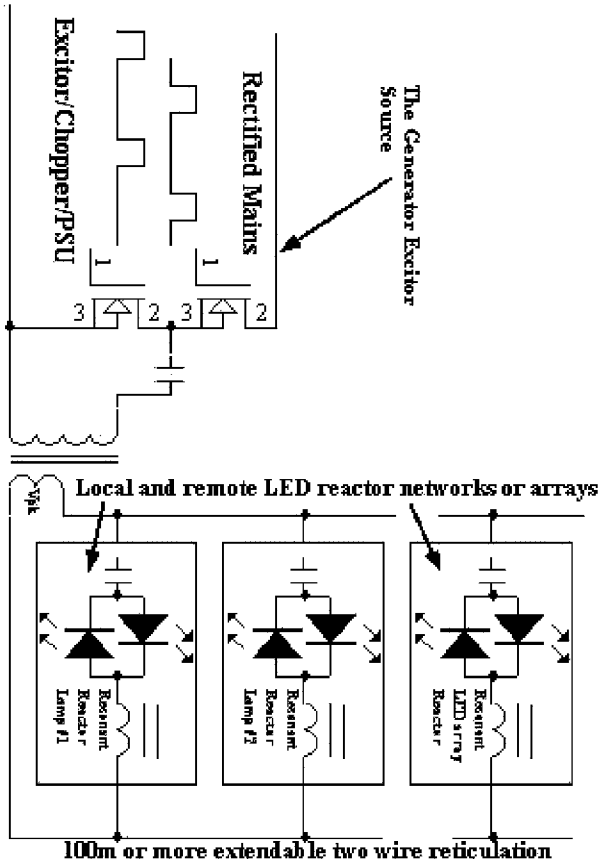
FIG. 14 shows an excitor driving a plurality of remote reactors via a two-wire connection.
Figure 15:
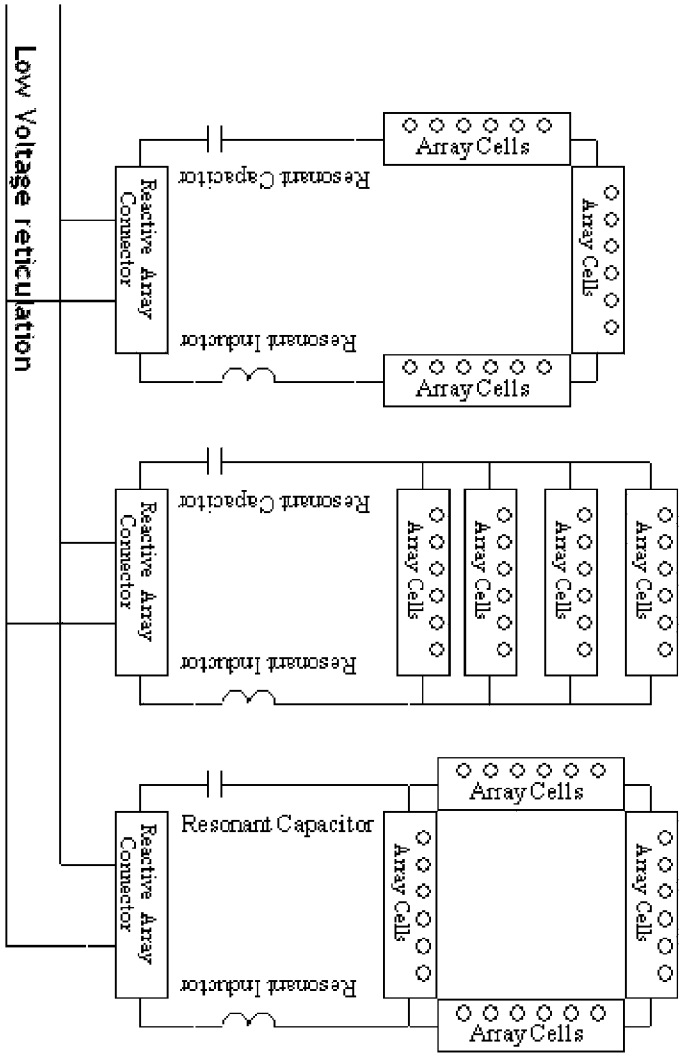
FIG. 15 show possible variants of connections for a plurality of reactor arrays.
Figure 16:
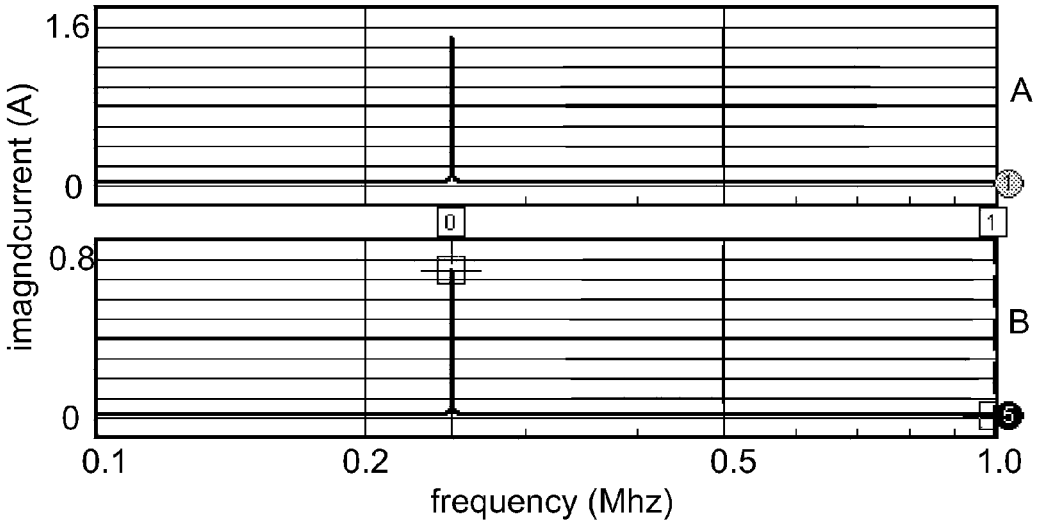
FIG. 16 shows the effect of adding a reactor array to an unloaded circuit.

Adding reactors increases the lagging phase energy accumulated from the multiple reactors and drives the excitor further into zero-voltage switching such that the waveform becomes an approximation of a sine wave and emissions are minimised. Such an arrangement is represented by FIG. 14, where the "plugged in" luminaires represented diagrammatically can be any of the species shown in FIG. 11, 12, or 13 made of the various "cells" shown in FIG. 11(*a*), or referenced elsewhere. More extreme version of these various reactive array configurations are shown in FIG. 15. These configurations can be driven provided that all the arrays achieve a breakover voltage (related to the lowest $V_{frwd}$ of any diode in either phase) to starts the breakdown cascade. The impact of inserting a "reactive array" of LEDs (as variously described) on the Q of the resonance is shown in FIG. 16. The insertion of the energy absorbing LEDs (which have a reasonable constant voltage in conduction) into a resonating circuit does not alter the resonant frequency, because the reactive array represents pure resistance to the reactive transfer of resonant energy between the nominally lossless reactive elements (capacitors and inductors) of the resonating circuit.

Generally, LEDs in reactor arrays are arranged in pairs such that the cathode of one is connected to the anode of the other and the cathode of the second is connected to the anode of the first. This pair or "couplet" is further connected to a series current-limiting capacitor to form a "cell", and the cell can be further connected in parallel with another capacitor which provides a current bypass for the current driving the LED. This bypass capacitor is in series with other bypass capacitors (for example, C1, C3, C5, C7, and C9 in FIG. 11) which provides a regulation of the voltage across the couplet by voltage division, while the series capacitor for each couplet provides current balance between the two LEDs in the couplet. Because the operating resonant frequency is high, the required capacitance values are small. An open-circuit failure of an LED reduces the current flow in the branch, which reduces the aggregate capacitance thereby increasing the resonant frequency of the reactor. The reactor resonant frequency becomes more distant from the excitor drive frequency and so reduces the resonant current. Thus the surrounding LEDs locus of current regulation may remain unchanged, and neighbouring cells of the array are unaffected. A similar adjustment occurs for short-circuit failure, although such failures are far less common. Both short- and open-circuit failures are demonstrated in FIGS. 5,6,7 & 8. A short circuit decreases the voltage across the failed short-circuited LED, and the current through the bypass capacitor decreases to compensate.

Turning now to the figures, FIG. 1 shows a schematic representation of a prior art power supply apparatus used in LED illumination. A chain of LEDs 108 connected in series is shown driven by a DC current source with all the sensing and control required to provide controlled output illumination. The AC mains 100 feeds a rectifier and power factor correction (PFC) 102, the output of which goes to a DC-to-DC controller 104. The output of controller 104 goes to a further rectification and filtering stage 106 which, in turn, provides current-regulated DC power with voltage limit control. Feedback path 110 provides current and voltage regulation. The same series LED chains are used in U.S. Pat. No. 7,573,729 B2 to Elferich and Lurkens which uses two such serial chains. An entire chain is disabled if any one LED element open-circuit fault occurs.

Figure 2:
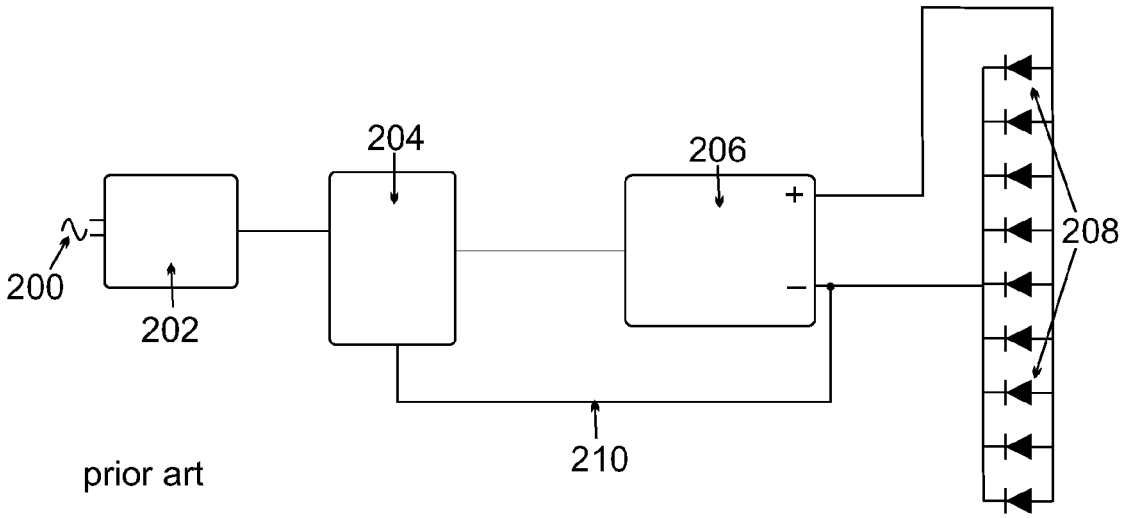
FIG. 2 shows a prior art system for DC driving a parallel-connected chain of LEDs.

FIG. 2 shows a schematic representation of a prior art power supply apparatus for a set of LEDs 208 connected in parallel. The AC mains 200 feeds a rectifier and power factor correction (PFC) 202, the output of which goes to a DC-to-DC controller 104. The output of controller 204 goes to a further rectification and filtering stage 206 which, in turn, provides current-regulated DC power with voltage limit control. Feedback path 210 provides current and voltage regulation. The conversion from the high voltage to low mains to the required LED drive voltage such as 1.2 V for parallel operation is inherently inefficient. Good control of luminous output requires tight voltage regulation and complex circuitry which can be unreliable and difficult to support, manufacture, and maintain.

FIG. 3 shows the principle elements of the excitor-reactor of embodiments of the present invention. The excitor 302 converts the incoming power such as mains 300 at 240 Vac or 110 Vac to an excitor waveform on the primary side of an isolation transformer 306. The mains is rectified and provided with PFC at 306 and converted to a high-frequency chopped waveform at 310. If a dimming feature is desired, it can be provided by programming a higher frequency drive at 310 for the excitor waveform. The reactor 304 is a resonant circuit driven from the secondary side of the isolation transformer 306. As illustrated, there are two separate resonant circuits 312 and 314 provided using a centre-tapped output on the secondary, although a single output circuit can also be used. Each circuit is shown driving three cells 316. Each cell comprises a couplet of LEDs 318 connected anode-to-cathode with a series current limiting capacitor 320 and a parallel bypass capacitor 322. The power delivered to individual LEDs is substantially constant and self-regulated by the resonant reactor circuit.

FIG. 3*a* shows key elements of the rf excitor drive circuit 330. The power stage consists of two power MOSFETs 332 driven by pulsed gate drive waveforms 334 and two capacitors 336 feeding the primary side of the isolation transformer 338 using a half bridge topology. The light-emitting elements are shown generically as a "reactance string" 342 in the reactor 340 on the secondary side of isolation transformer 338 which serves as active functional damping of the resonant output stage. and it that forms the reactor. The entire circuit can operate at efficiencies (power out/power in for the half-bridge converter) approaching 95%.

Figure 3B:
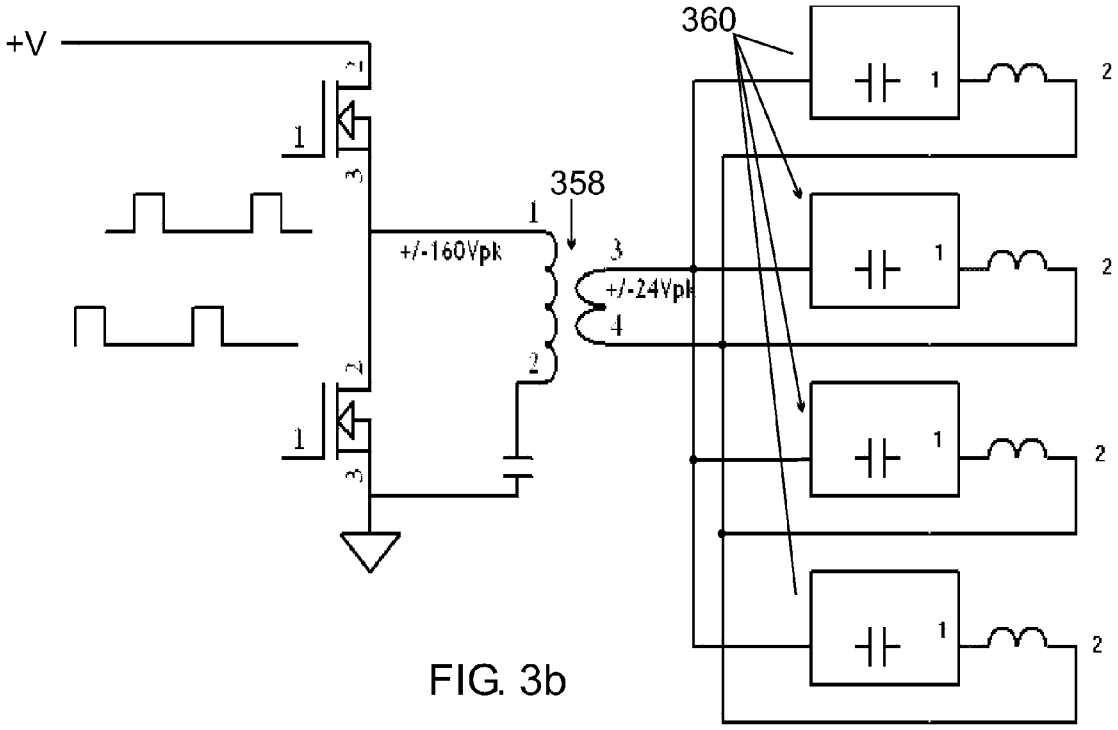
FIG. 3*b* shows an exemplary circuit for an excitor driving multiple reactors.

FIG. 3*b* shows a simpler and equally effective circuit for the excitor. The circuit is effective because of the inherent high Q of the reactor circuitry. The excitor can run directly from poorly filtered rectified mains voltage (+V) with sufficient mains EMC (electromagnetic compatibility) filtering only. Direct DC drive from a battery or photovoltaic source is also possible. Minimal parts, constant zero-voltage switching, and a non-regulating stage can result in high reliability. The example reactor 360 in FIG. 3*b* comprises four individual reactors 362 connected in parallel across the secondary of the isolation transformer 358. The excitor 350 and reactor 360 are connected by a 2-wire connection.

Figure 3C:
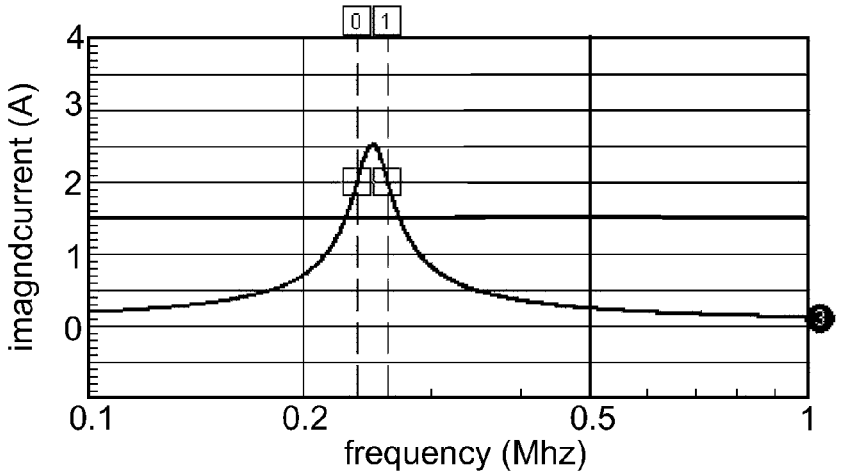
FIG. 3*c* shows a typical resonance peak.

FIG. 3*c* shows the resonance in the frequency domain. (the vertical axis "imagndcurrent" is the current magnitude ground current from the frequency analyser.) The realistic parasitic effects widen the bandwidth and reduce Q. This widening provides tolerance that easily allows additional LEDs to be added without destroying resonance. Compare FIG. 16 which shows that going from zero (FIG. 16*a*) to 20 LEDs (FIG. 16*b*) in a reactor circuit does not change the resonant frequency; the amplitude of the resonance drops, but the circuit continues to resonate.

Figure 4:
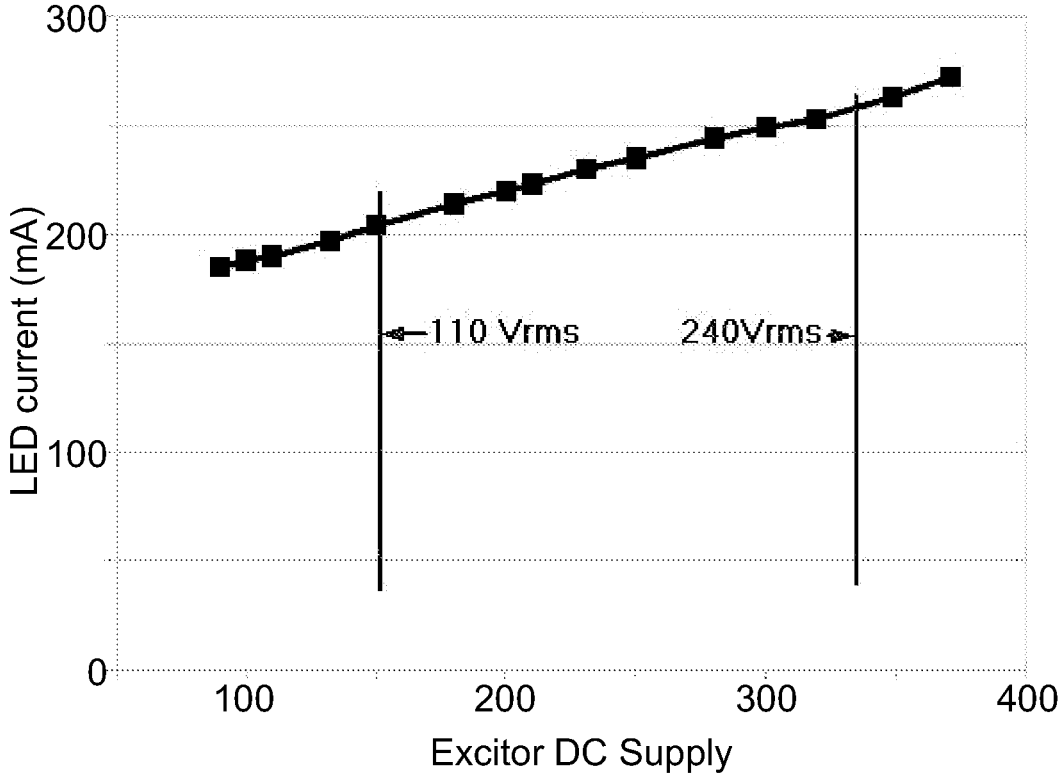
FIG. 4 show the reactor array current as a function of excitor supply voltage.

FIG. 4 shows a plot of measured LED current as a function of the excitor peak supply voltage for an embodiment of the present invention such as the circuit of FIG. 3*a*. The luminous flux of the array varies directly with the LED current. As shown, there is a small change in the measured current (and hence luminous flux), that is much less than the large change in the drive voltage. For example, the current increases by about 27% when the excitor voltage increases from 110 $V_{rms}$ to 240 $V_{rms}$, a factor of about 2.2. This relative insensitivity to supply voltage change can provide both brownout resistance and higher PFC.

Figure 5B:
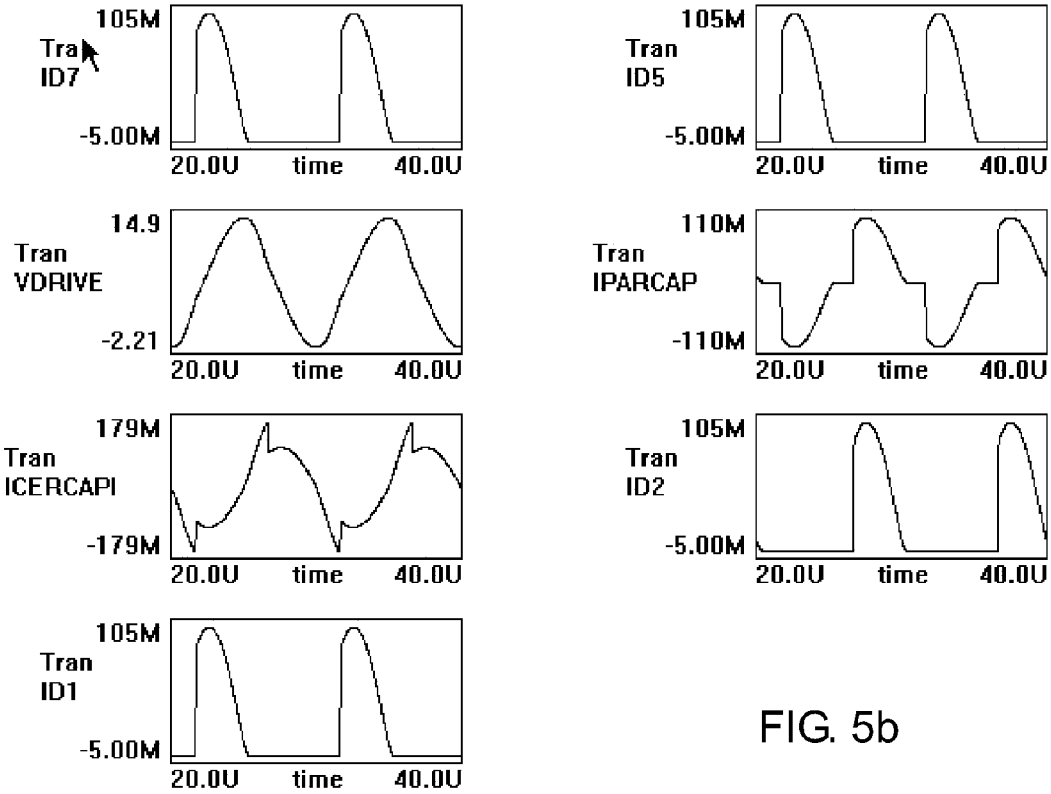
FIG. 5*b* shows selected current and voltage waveforms for the model array of lighting cells shown in FIG. 5*a*.

FIG. 5*a* shows a model reactor circuit that was used to generate the simulated waveforms shown in FIG. 5*b*. For simplicity in running the simulation, the circuit was driven be a constant AC current generator 500 as shown in FIG. 5*a*. The current generator is equivalent to a voltage generator plus an inductor. The overall drive voltage waveform $V_{drive}$ is near-sinusoidal at 100 kHz. The three forward-biased LEDs, D1, D5, and D7 have identical current waveforms ID1, ID5, and ID7 with output pulses during the positive half cycle of $V_{drive}$, while reverse-biased D2 shows a similar waveform ID2 with a 180° phase shift as expected. Series current limiting capacitor C2 passes current for both LEDs of the pair D1 and D2, as shown by the IPARCAP waveform. Parallel bypass capacitor C1 has current waveform ICERCAP1. The bypass capacitor peaks during the intervals when neither LED is conducting; the apparent "glitches" on the waveform appear during this interval. Both C1 and C2 have values of 0.1

Figure 6A:
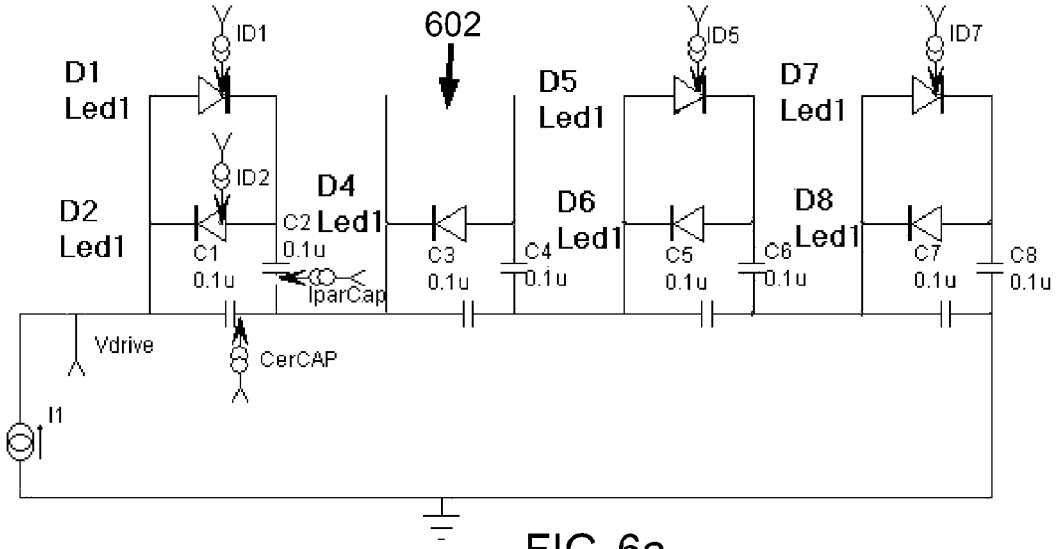
FIG. 6*a* shows a model array of lighting cells, similar to that of FIG. 5*a* with one failed LED (open circuit).
Figure 6B:
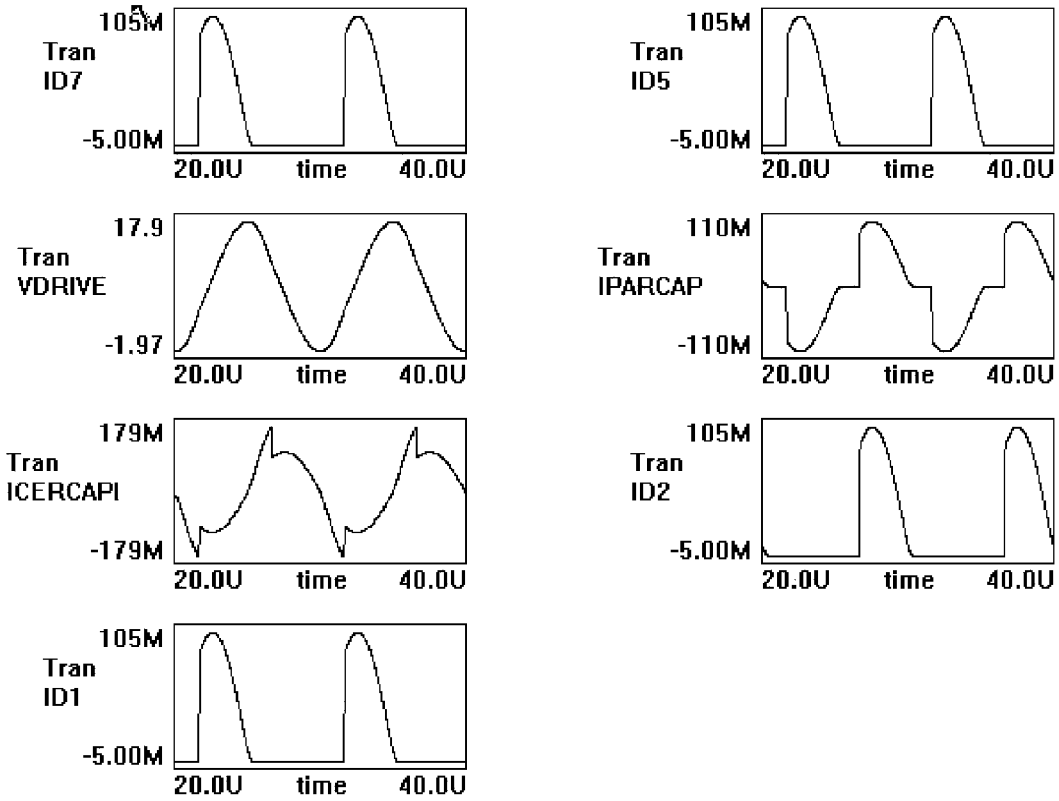
FIG. 6*b* shows selected current and voltage waveforms for the model array of lighting cells shown in FIG. 6*a*.

FIG. 6*a* shows the same circuit as FIG. 5*a* with an open circuit failure 602 of D3. FIG. 6*b* shows the same simulated waveforms as FIG. 5*b* but with the diode failure included. The drive voltage $V_{drive}$ has compensated by increasing the peak-to-peak amplitude from 17.1 V to 19.9 V, but the current waveforms in the remaining devices have remained unchanged.

FIG. 6*c* shows a circuit similar to that of FIG. 5*a* where D3 is connected in series with D7 to simulate a doubling of $V_{frwd}$ for D3. FIG. 6*d* shows current waveforms for D3, D4, and a voltage waveform for the series capacitor C4. There is a small shift in the time at which D3 turns on compared to the time at which D3 turns on, but the peak current remains the same. This shift is easier to see in FIG. 6*e*, where the current waveform for D3 with doubled $V_{frwd}$ is compared to the current waveform for normal diode D1. FIG. 6*e* also shows the near-sinusoidal voltage waveform across the parallel bypass capacitor C3. Even a large change in $V_{frwd}$ as in this example produces only a very small change in the average current and light output for D3.

Figure 7A:
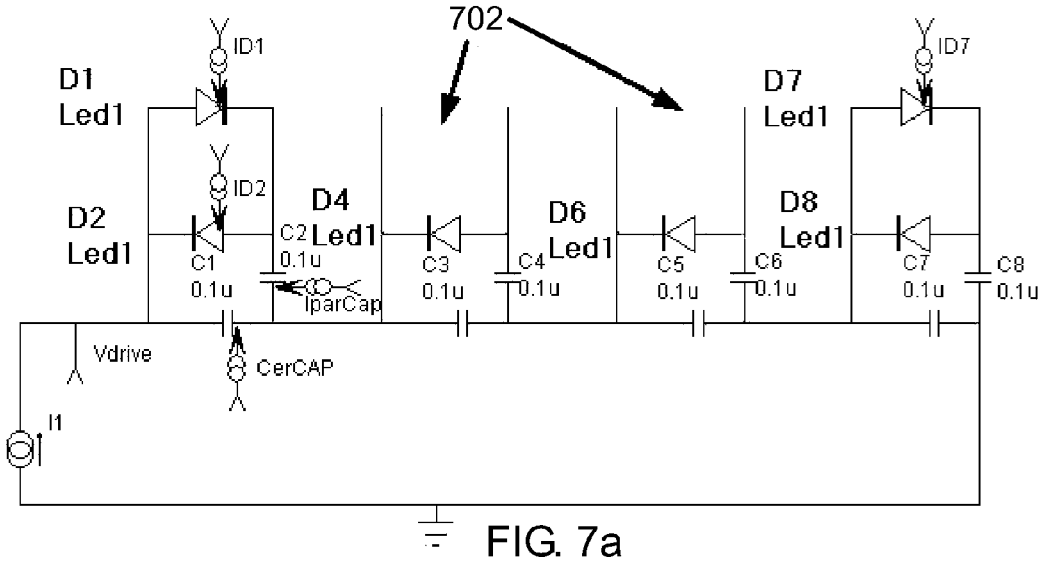
FIG. 7*a* shows a model array of lighting cells, similar to that of FIG. 5*a* with two failed LEDs (open circuit).
Figure 7B:
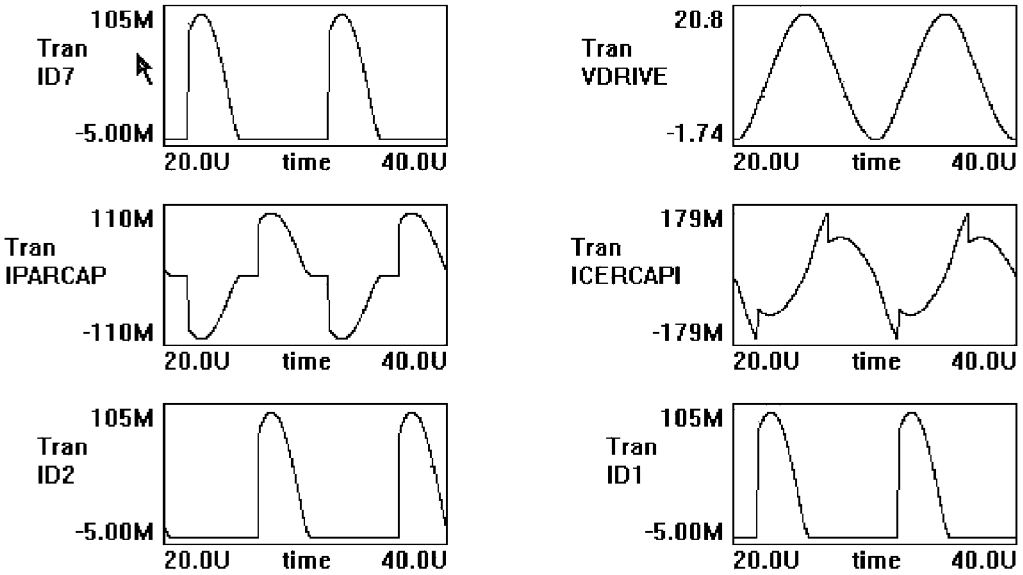
FIG. 7*b* shows selected current and voltage waveforms for the model array of lighting cells shown in FIG. 7*a*.

FIG. 7*a* shows the same circuit as FIG. 5*a* with an open circuit failure 702 of two LEDs, D3 and D5. FIG. 7B shows the same simulated waveforms as FIG. 5*b* with the two diode failures included. The drive voltage Vdrive has compensated by increasing the peak-to-peak amplitude from 17.1 V to 22.5 V, but the current waveforms in the remaining devices have again remained unchanged.

Figure 8A:
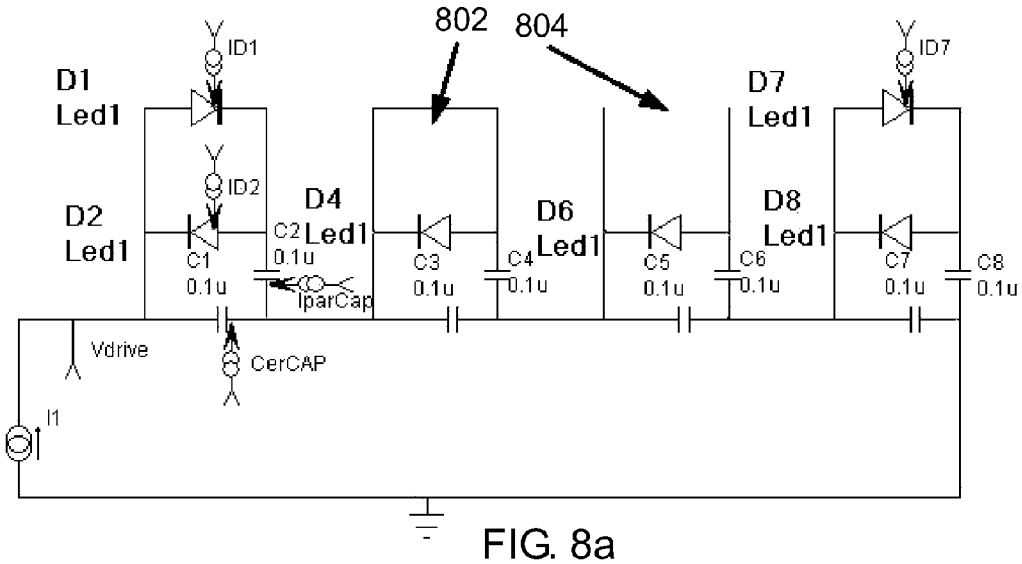
FIG. 8*a* shows a model array of lighting cells, similar to that of FIG. 5*a* with two failed LEDs (one open circuit, one short circuit).
Figure 8B:
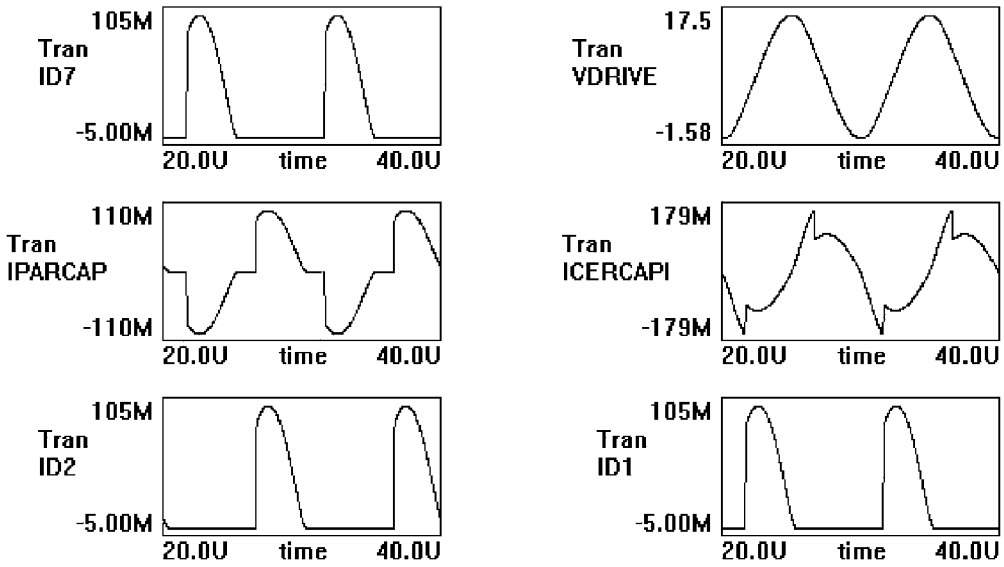
FIG. 8*b* shows selected current and voltage waveforms for the model array of lighting cells shown in FIG. 8*a*.

FIG. 8*a* shows the same circuit as FIG. 5*a* with two failed LEDs, D3. and D5, D3 being shorted 802, and D5 open 804. FIG. 8B shows the same simulated waveforms as FIG. 5*b* with the two diode failures included. The drive voltage Vdrive has compensated by increasing the peak-to-peak amplitude from 17.1 V to 19.1V, but the current waveforms in the remaining devices have again remained unchanged.

Figure 9:
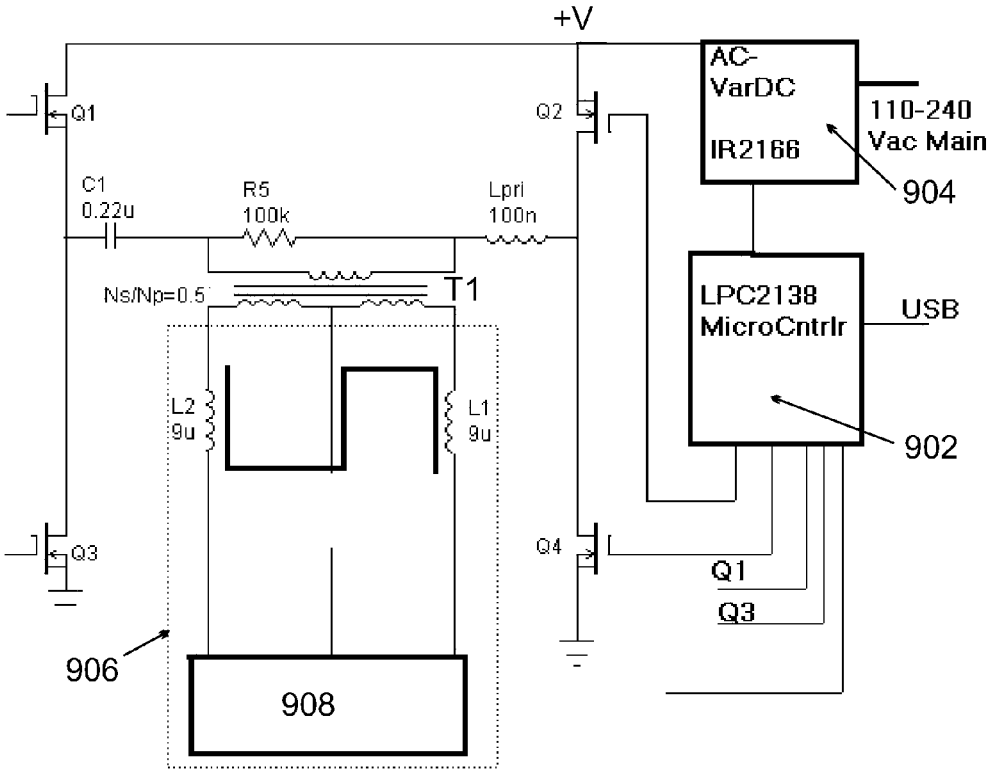
FIG. 9 shows a more detailed embodiment of an exemplary full-bridge excitor with external control.

FIG. 9 shows an excitor circuit according to some embodiments of the present invention with external supervision and digital control. The PFC function can be entirely digitally controlled. This circuit is full bridge for higher power compared to the half-bridge circuit of FIG. 3*a*. The PSU can be part of a "lighting network" and can communicate via a USB bus to a central control. The central control can provide dimming instructions and monitor fault conditions.

Figure 10:
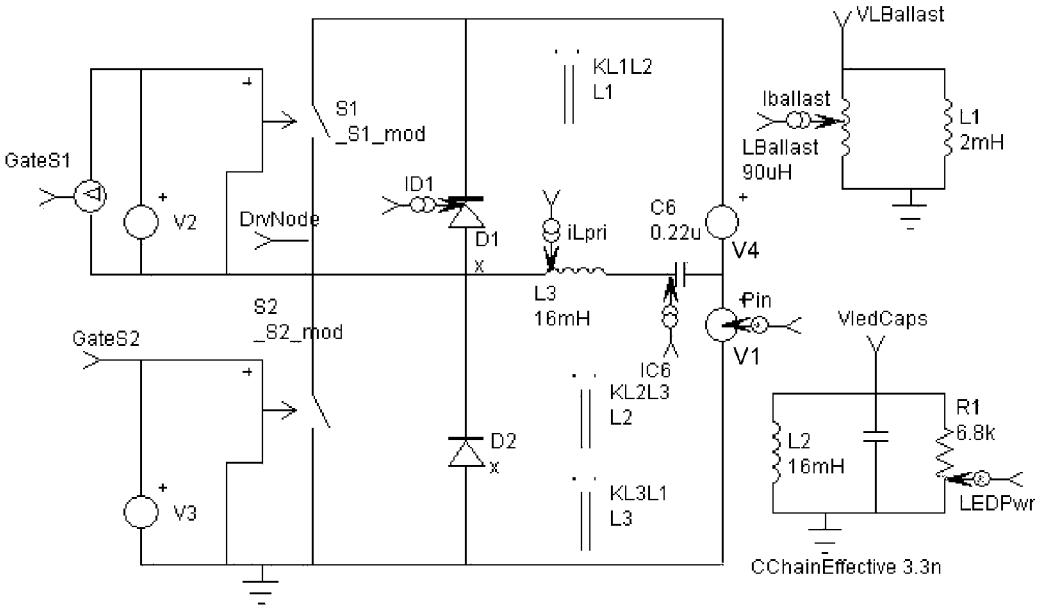
FIG. 10 shows a half-bridge power supply suitable for connection to reasonably regulated and rectified mains voltage.

FIG. 10 shows a half-bridge power supply suitable for connection to reasonably regulated and rectified mains voltage as might be used for typical incandescent and fluorescent lighting. In this circuit the half bridge storage capacitors are shown as voltage sources V1 and V4 with switches S1 and S2. The LEDs are simulated with a load resistor R1 dissipating "LEDpwr". This circuit simulator representation can rely on the standard voltages of either 240 $V_{rms}$ or 110 $V_{rms}$ as the sole regulation consistent with incandescent and fluorescent lighting and is one example of a multiple winding transformer (L3 is the primary while L1 and L2 are secondaries) where a single low voltage winding (L1 or L2) supplies a single reactor. Such a circuit is informative, because it models minimal coupling between primary and secondary windings providing lagging phase for zero-voltage switching in the primary side switches while injecting current at the correct phase to allow high secondary side currents. FIG. 10 shows just one example of a wide variety of configurations possible using alternative embodiments of the present invention and exploiting the auto-regulation seen in FIG. 4*a*.

Figure 11:
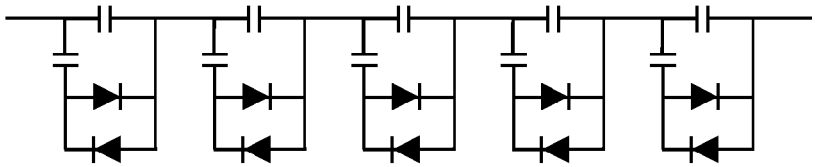
FIG. 11 shows an exemplary chain of LED cells.

FIG. 11 shows a 5-cell or 5-stage section from what could be a much larger LED reactive string comprising 10s or 100s of cells. Each cell includes two LEDs plus series and parallel capacitors. The parallel capacitor is sized to provide the desired bypass or recirculating current, and the series capacitor determines or limits the current and duty cycle for the couplet pair, and balances the current conducted by each member of the pair. This current balancing is achieved by the capacitor biasing so as to discharge equal current for both halves of the power cycle. The bypass capacitor also provides a current path that does not pass through the LEDs, enabling the rest of the circuit to continue to function when an LED fails open.

Figure 11A:
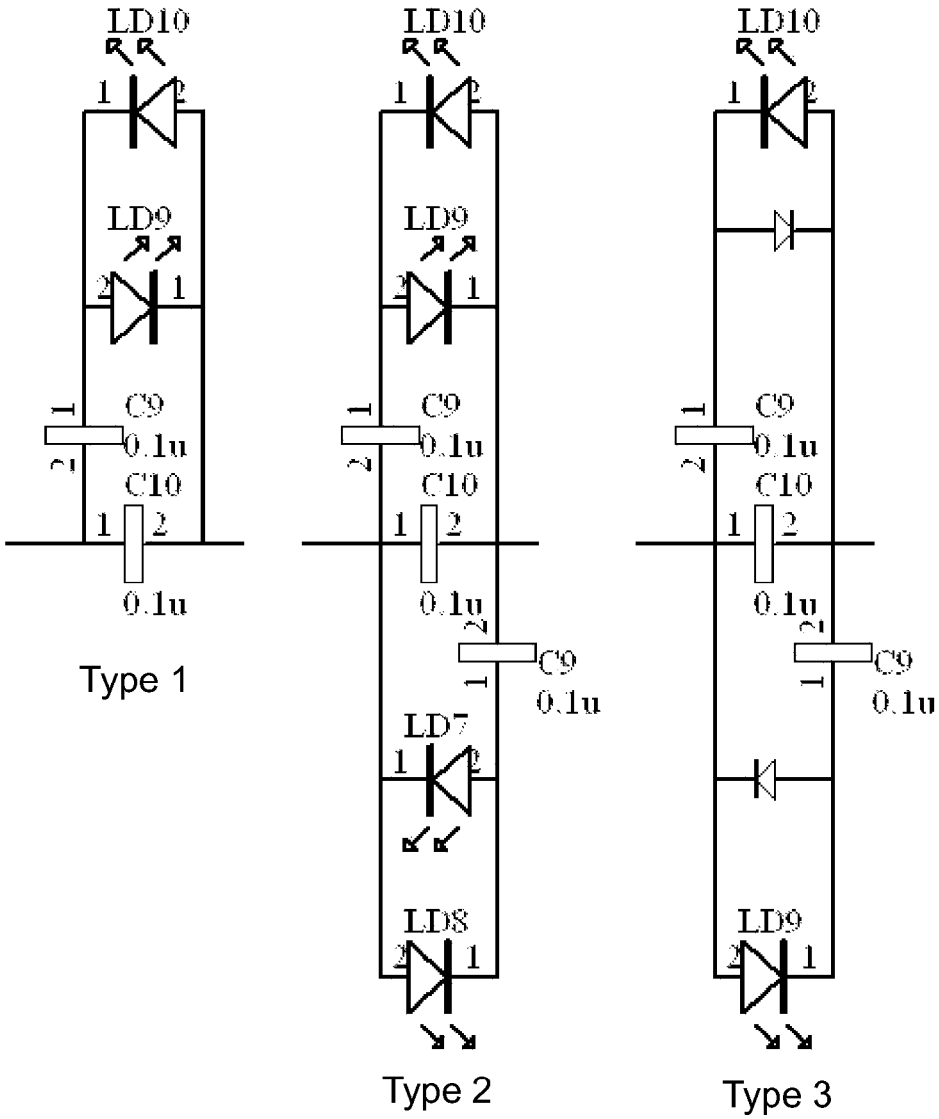
FIG. 11*a* shows three types of cells.

FIG. 11*a* shows exemplary embodiments of cells comprising LED couplets. The indicated capacitance values of 0.1 μf are exemplary and can be varied, for example, depending on the selected resonant frequency and the current requirements of individual LEDs. For example, arrays with more than one type of LED can be made by matching capacitance values to specific LEDs to provide the desired operating current to each LED. Type 1 has been used in FIGS. 3, 5-8, and 11. If any one LED in a Type 1 cell fails (either open or closed circuit), the companion LED in the cell will not function. Type 2 cells allows more LEDs to be driven by the oscillatory circuit at a lower voltage. Type 3 cells allows any LED to fail singly; the companion LED is unaffected.

Figure 11B:
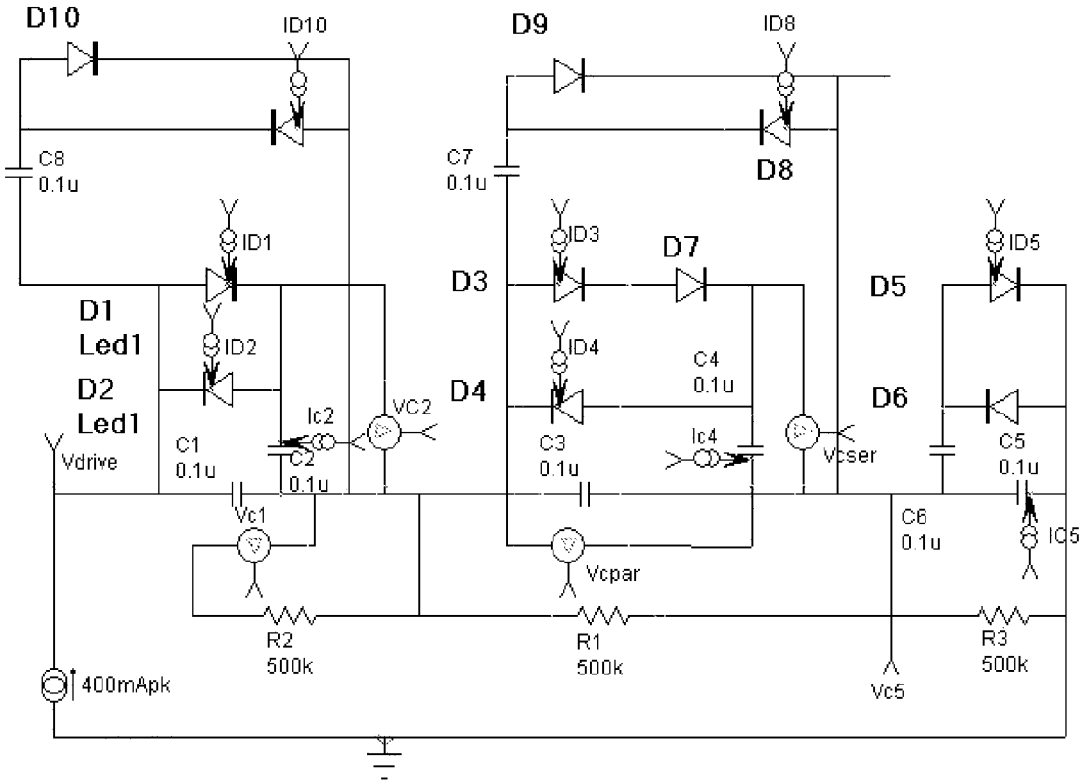
FIG. 11*b* shows a model array of lighting cells, similar to that of FIG. 5*a* with a network including multiple cell types.
Figure 11C:
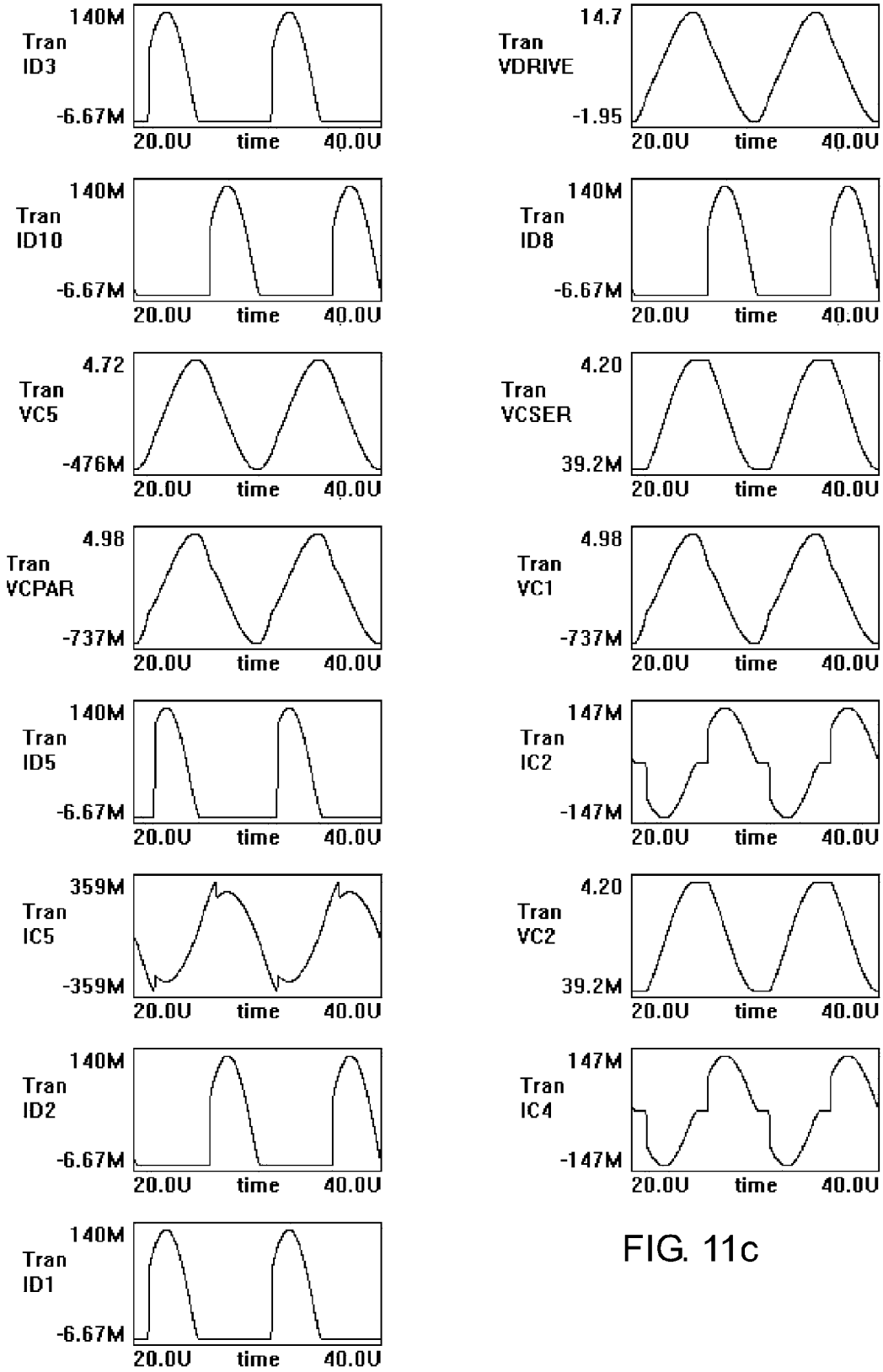
FIG. 11*c* shows selected current and voltage waveforms for the model array of lighting cells shown in FIG. 11*b*.

FIG. 11*b* shows a simulation circuit containing a complex array of different cell types. FIG. 11*c* shows selected current and voltage waveforms. All of the diode current waveforms are equivalent in spite of the varying cell types.

The controller shown in FIG. 9 is a full-bridge switched mode power supply which is more complex than the half-bridge power supply of FIG. 3. The full-bridge controller can be advantageously used for higher power lighting or image matrix control. Microcontroller 902 controls a lagging-phase, full-bridge controller and a variable-voltage DC supply 904 which can use, for example, a buck-boost architecture. Power supply 904 determines the DC voltage (+V) and consequently the power available to the reactive LED array from the full bridge circuit formed by the four FETs Q1-Q4 which are connected to the primary winding of a transformer T1 having a centre tapped secondary winding. The full bridge circuit acts as an excitor energy source for the resonating parallel LC circuit 906. Each of the secondary windings is connected via a mutually coupled inductor L1 or L2 to the reactive LED chain 908 which has a characteristic total capacitance. The capacitance of the LED reactive array 908, together with the entire lumped inductance comprising the self inductance of transformer T1, the primary inductance of T1, the full bridge MOSFETs and the inductors L1 and L2, all constitute a resonant circuit with a specific quality factor Q which is damped by the inherent power consumption of the LED elements excited in the driven reactive array. In this resonance the MOSFETS Q1-Q4 are only switched on when the voltage across them is zero (zero-voltage switching) thereby minimising the switching power loss and the EMI either radiated or conducted.

The frequency of oscillation of the excitor, approximately 100 kHz in this exemplary embodiment, is determined by the frequency of the microcontroller drive 902. The natural resonant frequency of the resonant circuit is designed to be close to, but not equal to, this set frequency such that altered reactor impedance reflects greater or lesser current through the coupled inductors. The coupled inductors represent a complex impedance such that, for example, greater current drawn by the load results in less output voltage and less current results in greater output voltage.

The excitor output voltage is selected according to the number of LEDs in the array and the array type. The control of output power is set by the output voltage from the variable output voltage AC to DC converter 904 which is set to provide a voltage commensurate with the desired output power level as well as the capacitance and inductance of the reactor resonant circuit.

The circuit has an efficiency limited primarily by the magnetisation power loss in the inductors and transformer and conduction losses in the switching elements. In lagging-phase bridge circuits, these constitute almost the entire loss, because the circuit operates at zero-voltage switching, and overall power conversion efficiencies as high as 95% can be achieved. However, there is a consequence to the reactive or circulatory power in the network as shown in the waveforms 6b, 7b, and 8b which is not used for the purpose of LED light stimulation. In the example embodiments of FIG. 12 (cells connected in parallel), the circulatory current is equal to the current through the LEDs achieving optimal current to luminosity conversion. The degree to which this desirable depends on the current-carrying capacity of the system wiring.

Conventional DC drivers for light emitting elements such as LEDs must convert mains voltages of 110-240 Vac to low voltages such as 2-4 Vdc. Such a reduction in voltage is inherently inefficient. By contrast, embodiments of the present invention require no rectification or regulation at the secondary stage but rely on the natural limitation of energy in the reactor resonant circuit and the current control in individual LEDs provided by the capacitor elements in the reactor. The LEDs provide the rectification normally provided by the secondary stage of a conventional power supply. The under-damped oscillation of the reactor resonating circuit has an inherent regulating property. Direct energy transfer takes place between the energy source and the load. Regulation curves such as can be seen in FIG. 5*b* are entirely adequate when the load is practically constant (as with LED arrays).

A single cell of Type 1 (see FIG. 12) as used in FIG. 5*a* or 11, has a capacitance of (C1+C2) assuming C2 to be carrying $I_{frwd}$ for one of the LEDs. If N such cells are arranged in series, the total capacitance $C_{total}$=(C1+C2)/N. The inductance and the capacitance are chosen for a particular array size or string length. The total capacitance to be "seen" by the excitor part is chosen together with the series inductance to provide resonance at the desired frequency. For example, FIG. 11 shows 5 cells but extended branching as of type 2 in FIG. 11A. If the capacitance values are all set to 0.1 μF, then the total capacitance $C_{total}$ is given by (C1+C2)/5=40 nF. The effective capacitance represented by the string is required to create a pole at a much lower frequency than the extant effective resonant pole, and the deployment of a series $C_r$ to the reactive array can effectively determine the resonant capacitance determining any frequency operating point. This difference in resonant capacitance and the effective net distribution capacitance is at least about a factor of five.

The actual circuit shows a predisposition to oscillation exceeding that found in simulation as stated above. Measurement of array capacitance was made with an LCR meter using a low voltage of about 100 mV where the LED elements are shorted out and not conducting. In this non-conducting regime, the capacitance is expected to be highly non-linear. In practice, the conventional equation for series resonance $\omega_0=(LC)^{-1/2}$ is roughly valid using $C=1.5\times C_{measured}$ for the purpose of calculating the series inductor. The series inductor can typically be a small ferrite depending on the array size and power required.

Figure 18:
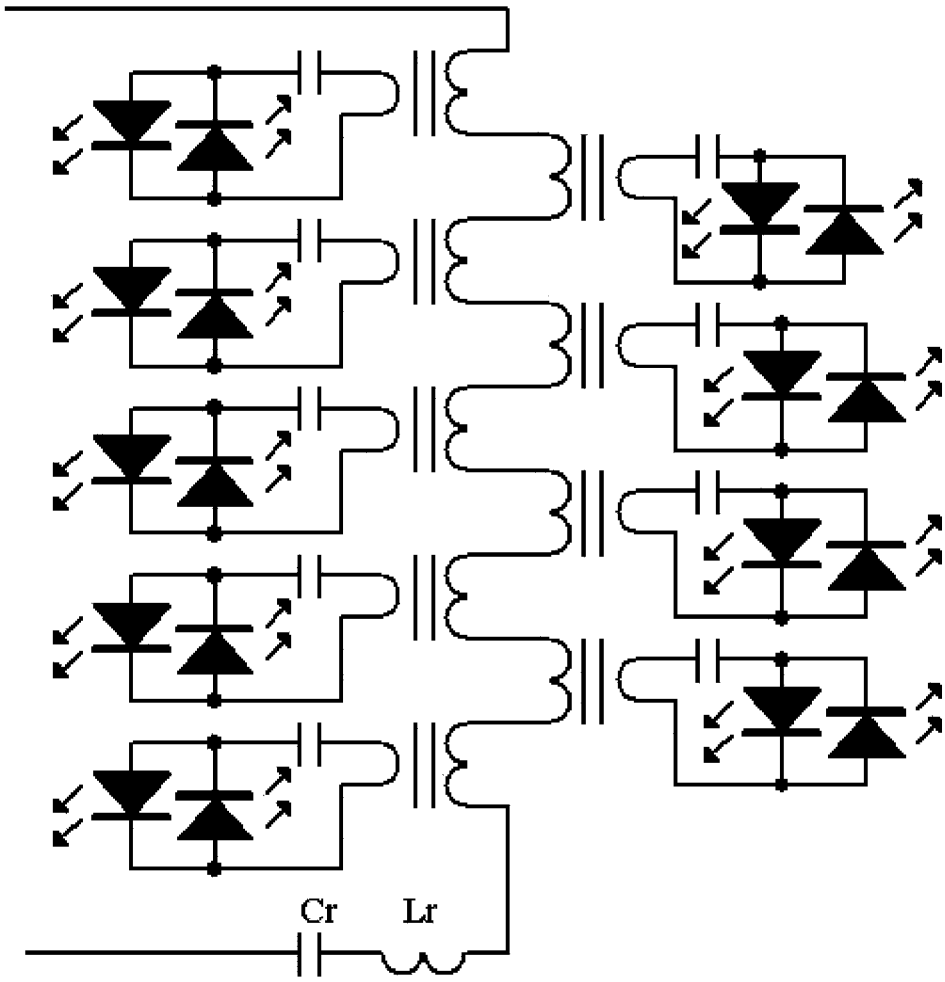
FIG. 18 shows a magnetically coupled reactive string.

The flexibility of the excitor function and capacitances for the reactor can be further increased by the choice of windings for L1, L2, and L3 in FIG. 10 which can each magnify or diminish the reactive components according to the turns ratio squared they present to each other or to the primary L3 (the excitor winding). It is also possible to use the inductances of the secondary windings to control the relative current (power) delivered to separate reactor arrays. The embodiments described above generally used capacitors to set relative currents, in part, because the required capacitors are low-cost and easily deployed. However, in some embodiments, a set of low-cost ferrite inductor can be contained in secondary windings to provide similar functionality while the same primary winding can be common to all inductors as shown in FIG. 18.

The natural power regulation provided by embodiments of the present invention allows fast and automatic response when changing reactor parts or fixing faults among the elements in a reactor while the reactor is active. In such dynamic reactor structures, higher frequency operation can require very small reactive elements. Furthermore, it is not necessary to turn off the excitor power when switching element in the reactor. A limiting damping resistance can be added in parallel with the resonant circuit which otherwise theoretically approaches infinity at a momentary zero load (in practice infinite impedance does not occur due to natural circuit element parasitic losses). Any loading by different impedances as elements are switched in or out causes immediate adaptation in the same way as the element failure examples shown in FIGS. 7 and 8. Any momentary transition disturbance is critically damped by the selective nature of the inherent filter of the circuit in resonance providing the energy.

The combination of high efficiency, minimal parts count, few active parts, no linear active parts, high isolation, and user safety provides unique opportunities for packaging. For example, an excitor can be built into a small fanless package suitable for small arrays that can be placed in a sub-floor, ceiling, or wall locations without concern for heat generation, high voltage exposure, or fire proofing.

As shown in FIG. 9, a communication pathway can exists between the excitor and an information network or individual computer. Such communications can be used to allow large lighting networks to be managed effectively for both control and maintenance functions by small groups of people.

A feature of the AC drive of LEDs in that individual elements are effectively driven by pulsed waveforms having less than 50% duty cycle and a high "crest factor" waveform. Referring to FIG. 17, a couplet has LEDs which are alternately illuminated (shown, for convenience, as driven by square waves). LED luminous power is generally limited by heat dissipation from the device, so a device driven at 50% duty cycle can be overdriven by a factor of two for the same average heat dissipation and, to a first approximation, the same average light output. Experiments were conducted to compare DC constant current drive to AC drive at an equivalent rms current (the same average electrical power input) for blue XPE LEDs (Cree, Inc.) driving phosphors (Intematix Corp.) to create white light. Light output was measured using a meter that measures lux or $lm/m^2$ (lm is short for lumens which is a measure of the perceived power of emitted light, taking into account the normal response of the human eye). The measured output using the AC drive was 70 lux at 3 m for 18 W of input power. This was about 10% higher when driven by AC compared to DC drive. The net conversion of electrical power to useful illumination power was improved by using the shorter duty cycle, higher power drive inherent in circuits using embodiments of the present invention.

It is useful to characterise a reactor in terms of a current utility ratio (CUR) which is the ratio of rms current through the lighting elements of the reactor to the total current flowing through the reactor. Typically, the CUR is between about 0.3 and about 0.95. The current not flowing through the lighting elements flows through reactive bypass elements (generally capacitors in the example circuits shown in the figures). The CUR can be varied according to the particular application. Generally, the CUR determines various important parameters including the current through the lighting elements and the voltage across the lighting elements. For LEDs, the CUR determines both forward and reverse bias voltages. The CUR also determines a level of failure sensitivity and/or the ability to add and remove lighting elements (usually as cells including associated reactive elements). A lower CUR generally provides more failure tolerance and the ability to remove or add more lighting elements. However, the lower CUR means that a higher total current must be provided than for a higher CUR. Thus lower CURs can result in some overall loss of efficiency to the extent that the real reactive elements have losses.

The foregoing describes only one embodiment of the present invention and modifications obvious to those used skilled in the engineering arts, can be made thereto without departing from the scope of the present invention. For example, the power supply can be wholly digital allowing only one low complexity and low cost electronic component to provide the excitor waveform and power as well as overall network control interaction and maintenance management relating heating and deterioration information to be detected and transmitted to a remote system controller or monitor.

What is claimed is:

1. A lighting system comprising an excitor comprising an electrical waveform generator; and a reactor comprising a resonant circuit;

wherein said resonant circuit comprises a plurality of reactive components and a plurality of lighting elements;

wherein said excitor is operable to drive said resonant circuit;

wherein the electrical waveform generator is operable to generate an AC waveform at a frequency between about 50 kHz and about 100 MHz;

wherein a first subset of said plurality of reactive components determines the power in a first lighting element of said plurality of lighting elements, and a second subset of said plurality of reactive components determines the power in a second lighting element of said plurality of lighting elements; and wherein said resonant circuit is under-damped when driven by said excitor.

2. The lighting system of claim 1, wherein said reactor is in resonance;

wherein said plurality of reactive components comprises a plurality of bypass components which determine a current utility ratio (CUR) for the reactor, and wherein the CUR is between about 30% and about 95%;

where the current utility ratio is the ratio of current flowing through the lighting elements to current supplied to the reactor by the excitor.

3. The lighting system of claim 2, wherein said reactive components distribute current and voltage among individual lighting elements or pairs of lighting elements such that each lighting element or pair of lighting elements has individually regulated current which is a monotonic function of the CUR.

4. The lighting system of claim 2, wherein said reactive components distribute current and voltage among individual lighting elements or pairs of lighting elements such that each lighting element or pair of lighting elements has individually regulated voltage which is a monotonic function of the CUR.

5. The lighting system of claim 2, wherein said lighting elements comprise light emitting diodes (LEDs).

6. The lighting system of claim 5, wherein said reactor contains no active semiconductor elements other than said LEDs or steering diodes.

7. The lighting system of claim 5, wherein said LEDs are connected in pairs either with another LED or with a steering diode, wherein the cathode of each member of each pair is connected to the anode of the other member of the pair.

8. The lighting system of claim 7, wherein said reactive components distribute current and voltage among individual lighting elements or pairs of lighting elements such that each lighting element or pair of lighting elements has individually regulated forward bias voltage and reverse bias voltage which are a monotonic function of the CUR.

9. The lighting system of claim 7, wherein said reactive components distribute current among individual lighting elements such that when one LED in one pair fails, the power provided to LEDs in all other pairs remains serviceable.

10. The lighting system of claim 2, wherein said reactive components distribute current among individual lighting elements such that a non-zero number of lighting elements can be added and removed without affecting the serviceability of other lighting elements in said reactor.

11. The lighting system of claim 10, wherein the non-zero number of lighting elements that can be added and removed is a monotonic function of the CUR.

12. The lighting system of claim 1, wherein said resonant circuit has a resonant frequency sufficiently lower than the frequency of said AC waveform that switching components of said electrical waveform generator can operate with zero-voltage switching.

13. The lighting system of claim 12, wherein the light output of said lighting elements can be dimmed by increasing the frequency of said electrical waveform generator such that the Q of the resonance of said resonant circuit is lowered.

14. The lighting system of claim 1, further comprising a plurality of reactors;

wherein each reactor of said plurality of reactors comprises a resonant circuit comprising a plurality of reactive elements and a plurality of lighting elements, and wherein said excitor is operable to drive all of the reactors of said plurality of reactors.

15. The lighting system of claim 14, wherein the light output of lighting elements in each reactor of said plurality of reactors can be dimmed as a group separate from the lighting elements in other reactors of said plurality of reactors.

16. The lighting system of claim 14, wherein one reactor of said plurality of reactors comprises lighting elements of a different type from lighting elements in another reactor of said plurality of reactors.

17. The lighting system of claim 14, wherein one reactor of said plurality of reactors comprises a different number of lighting elements from the number of lighting elements in another reactor of said plurality of reactors.

18. The lighting system of claim 1, wherein said plurality of lighting elements comprise elements of an imaging display device.

19. The lighting system of claim 1, wherein said reactor is separated from said excitor by a distance of between about 2 m and about 1000 m, and said reactor is connected to said excitor by a two-wire connection.

20. A lighting component operable as the reactor of claim 1, said lighting component comprising a plurality of cells, each cell comprising at least one lighting element, a series reactive element, and a parallel reactive element.

21. A method of driving a plurality of lighting elements comprising connecting a plurality of lighting elements in a reactive string comprising a plurality of reactive components; and driving said reactive string with an AC waveform at a frequency between about 50 kHz and about 100 MHz;

wherein said AC waveform is generated by an electrical waveform generator;

wherein said plurality of reactive components are operable to distribute current among individual lighting elements such that each lighting element has individually regulated power; and wherein said reactive string forms part of an under-damped resonant circuit having a resonance with a quality factor Q.

22. The method of claim 21, wherein said reactive string has a resonant frequency sufficiently lower than the frequency of said AC waveform, that said resonant circuit has lagging phase relative to said AC waveform, and switching components of said electrical waveform generator can operate with zero-voltage switching; and wherein the method further comprises dimming the light output of said lighting elements by increasing the phase lag of said lagging phase such that the Q of the resonance of said resonant circuit is lowered or raised.

* * * * *